US006880501B2

(12) United States Patent
Suh et al.

(10) Patent No.: US 6,880,501 B2
(45) Date of Patent: Apr. 19, 2005

(54) INTERNAL COMBUSTION ENGINE

(75) Inventors: Nam P. Suh, Sudbury, MA (US); Nam-Hyo Cho, Kyonggi-do (KR)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 10/354,897

(22) Filed: Jan. 29, 2003

(65) Prior Publication Data

US 2003/0230259 A1 Dec. 18, 2003

Related U.S. Application Data

(63) Continuation-in-part of application No. 10/209,464, filed on Jul. 30, 2002, now Pat. No. 6,789,514.

(60) Provisional application No. 60/308,959, filed on Jul. 30, 2001, provisional application No. 60/313,123, filed on Aug. 16, 2001, provisional application No. 60/317,693, filed on Sep. 6, 2001, and provisional application No. 60/346,228, filed on Oct. 24, 2001.

(51) Int. Cl.[7] ..... F02B 33/22; F02B 75/20

(52) U.S. Cl. ..... 123/70 R; 123/58.8

(58) Field of Search ..... 123/70 R, 70 V, 123/71 R, 72, 58.8

(56) References Cited

U.S. PATENT DOCUMENTS

| | | | |
|---|---|---|---|
| 1,168,425 | A | 1/1916 | Rosenhagen |
| 1,904,816 | A | 4/1933 | Beaudry |
| 2,058,705 | A | 10/1936 | Maniscalco |
| 2,522,649 | A | 9/1950 | Tenney |
| 2,594,845 | A | 4/1952 | Baumann |
| 2,736,488 | A | 2/1956 | Dros |
| 3,408,811 | A | 11/1968 | Wishart |
| 3,623,463 | A | 11/1971 | DeVries |
| 3,675,630 | A | 7/1972 | Stratton |
| 3,774,581 | A | 11/1973 | Lundy |
| 3,880,126 | A | 4/1975 | Thurston et al. |
| 3,911,878 | A | 10/1975 | Hofbauer et al. |
| 3,959,974 | A | 6/1976 | Thomas |
| 4,170,970 | A | 10/1979 | McCandless |
| 4,333,424 | A | 6/1982 | McFee |

(Continued)

FOREIGN PATENT DOCUMENTS

| | | | | |
|---|---|---|---|---|
| DE | 879183 | | 6/1953 | |
| FR | MC.490 | | 6/1965 | |
| GB | 646092 | | 4/1948 | |
| GB | 2071210 | A * | 9/1981 | ..... F02B/33/22 |
| WO | WO82/04290 | A1 | 12/1982 | |
| WO | WO 90/15917 | | 12/1990 | |
| WO | WO93/21433 | A1 | 10/1993 | |
| WO | WO 01/46574 | A2 | 6/2001 | |

OTHER PUBLICATIONS

*Nam P. Suh, "The Principles of Design" Oxford University Press, 1990.

*Nam P. Suh, "Axiometic Design Advances and Applications" Oxford University Press, 2001.

*John B. Heywood & Eran Sher "The Two–Stroke Cycle Engine" 1999 pp. 62–72, Taylor & Francis Publishers, Philadelphia, PA.

*Primary Examiner*—Henry C. Yuen
*Assistant Examiner*—Hyder Ali
(74) *Attorney, Agent, or Firm*—Wolf Greenfield & Sacks, PC

(57) ABSTRACT

An internal combustion engine that has a pair of cylinders each having a reciprocating piston connected to a crank shaft by a connecting rod. One of the cylinders is adapted for an air and fuel intake and a compression strokes only, and the other of the cylinders adapted for at least power and exhaust strokes. A conduit exists for transfer of gases from the one into the other cylinder after the compression stroke. The conduit has means for isolating gases in the conduit intermediate the compression and power strokes. Furthermore, the conduit is designed to prevent the transfer of liquefied fuel from the one cylinder to the other.

38 Claims, 36 Drawing Sheets

U.S. PATENT DOCUMENTS

| | | | |
|---|---|---|---|
| 4,372,264 | A | 2/1983 | Trucco |
| 4,493,296 | A | 1/1985 | Williams |
| 4,565,167 | A | 1/1986 | Bryant |
| 4,783,963 | A | 11/1988 | Thomas |
| 4,817,388 | A | 4/1989 | Bland |
| 4,854,280 | A | 8/1989 | Melchior |
| 4,865,002 | A | 9/1989 | Borst et al. |
| 5,060,609 | A | 10/1991 | Merritt |
| 5,101,782 | A | 4/1992 | Yang |
| 5,117,789 | A | 6/1992 | Merritt |
| 5,228,415 | A | 7/1993 | Williams |
| 5,265,564 | A | 11/1993 | Dullaway |
| 5,299,537 | A | 4/1994 | Thompson |
| 5,325,824 | A | 7/1994 | Wishart |
| 5,357,923 | A | 10/1994 | Osterburg et al. |
| 5,546,897 | A | 8/1996 | Brackett |
| 5,560,326 | A | 10/1996 | Merritt |
| 5,570,670 | A | 11/1996 | Powell |
| 5,857,436 | A | 1/1999 | Chen |
| 5,862,781 | A | 1/1999 | Rossle |
| 5,899,188 | A | 5/1999 | Firey |
| 6,003,487 | A | 12/1999 | Merritt |
| 6,019,075 | A | 2/2000 | Galka et al. |
| 6,026,769 | A | 2/2000 | Anbarasu et al. |
| 6,095,100 | A | 8/2000 | Hughes |
| 6,189,495 | B1 | 2/2001 | Tuckey et al. |
| 6,314,925 | B1 | 11/2001 | Britton |
| 6,318,335 | B1 | 11/2001 | Tomczyk |
| 6,340,004 | B1 | 1/2002 | Patton |
| 2002/0050253 | A1 | 5/2002 | Schmitz |
| 2003/0014971 | A1 | 1/2003 | Scuderi |
| 2003/0015171 | A1 | 1/2003 | Scuderi |

* cited by examiner

INTERNAL COMBUSTION ENGINE

CROSS REFERENCE TO RELATED APPLICATIONS

This application claims the benefit of and is a Continuation-In-Part of U.S. patent application Ser. No. 10/209,464, filed Jul. 30, 2002, now U.S. Pat. No. 6,789,514 which claims the benefit of U.S. Provisional Patent Application Nos. 60/308,959 filed Jul. 30, 2001, 60/313,123 filed Aug. 16, 2001, 60/317,693 filed Sep. 6, 2001, and 60/346,228 filed on Oct. 24, 2001.

FIELD OF THE INVENTION

The present invention relates to an internal combustion engine, and more particularly to a decoupled internal combustion engine whereby the mixing and compressing of air and fuel occurs within a first cylinder and power is derived from the second cylinder.

BACKGROUND OF THE INVENTION

The engine development process has often involved making decisions between competing engine characteristics, including fuel efficiency, power output, physical size, emission characteristics, reliability, and durability to name a few. In particular, emission characteristics are one criteria that are often evaluated by organizations like the Environmental Protection Agency (EPA). For instance, if some emission levels, such as nitrous oxides (NOx), hydrocarbons (HC), carbon monoxide (CO) or particulate matter are too high for an engine, the engine may require expensive exhaust treatments such as a catalytic converter. In other instances, the engine might not be certified for operation or sale if it has poor emissions characteristics. As a result, engine emissions should be carefully considered during the engine development process. Some issues surrounding engine development regarding emissions characteristics are described below.

Carbon monoxide and NOx emissions (including both NO and $NO_2$) are formed during combustion. Carbon monoxide generally results when combustion occurs with an air and fuel mixture that has more fuel than the stochiometric reaction requires (also known as a "rich" mixture). To address carbon monoxide concerns, most engines attempt to operate with stochiometric or lean (less fuel than stochiometric) air and fuel mixtures. However, some pockets of fuel rich zones will typically still exist in the air and fuel mixtures of conventional engines. These pockets can result in carbon monoxide production. Conversely, NOx emissions are high when the air and fuel mixtures are lean or near stochiometric values. Techniques used to address NOx formation often include the recirculation of exhaust gases into fresh air and fuel mixtures.

Among other causes, Hydrocarbon (HC) emissions can result from incomplete combustion or unburned fuel passing through a power cylinder during a period of intake and exhaust valve overlap. Cylinders of conventional engines often provide areas where it is difficult to sustain combustion, such as in the crevices between a piston and a cylinder wall. Additionally, most fuel injection systems cannot provide fuel that is completely evaporated before combustion begins. Fuel may also cling to the walls of a cylinder after it has been injected, forming a wet sheet of fuel that does not burn. This often leads to incomplete combustion in at least portions of a combustion chamber resulting in hydrocarbon emissions. Hydrocarbon emissions are often worse when an engine is first started, as the engines are typically cold and complete evaporation of fuel is difficult to support.

Both in compression ignition (diesel) and spark-ignition engines, the ratio of the fuel to air is not the same throughout the cylinder—thus not stochiometric throughout—due in part to poor mixing. Some part of the air and fuel mixture is fuel rich and some part is oxygen rich (i.e., lean). The crown of the piston (i.e., the top of the piston), the injection angle, and valve size and location, are some factors that are varied to control the flow of injected air and fuel mixture to improve mixing, however, they do not generally address the problem adequately. Non-stochiometric air and fuel mixtures may limit the maximum compression ratio of the engine, which controls the flame propagation speed and the combustion chemistry.

Another problem of conventional spark-ignition engines is knocking. Knocking limits the maximum compression ratio of conventional internal combustion engines and thus, the power efficiency of the engines. Knocking is a result of unwanted self-ignition or auto-ignition within the combustion chamber. To prevent knocking in spark ignition engines, it is most desirable to have a flame sheet that propagates from the ignition point outward at a high compression ratio. Due to the expansion of the gas behind the flame front, the unburned air and fuel mixture experiences high pressure and temperature before the flame front reaches the unburned region. When the pressure and temperature of the unburned air and fuel mixture are high enough, the mixture can self-ignite (i.e., auto-ignition), causing a rapid rise in pressure, which induces vibration of the cylinder walls and can create an audible knocking sound. This process is accelerated when there is enough time for sufficient auto-ignition precursors to form.

Two mechanisms control "knocking": the formation of precursors and the temperature rise that accelerates the flame propagation rate. At high engine speeds, knocking may not be a problem since there is less time available for the precursors to form. On the other hand, as engine speed increases, there is less heat loss from the gases so that gas temperatures will be higher. This accelerates the precursor formation rate so that less time is required to form a concentration high enough for auto-ignition to occur. As a result of these two competing effects, some engines experience knocking at high speeds and some experience knocking at low speeds.

Knocking can be severe when the air and fuel mixture is at its stochiometric ratio. This problem has been solved in current engines in two expensive ways: the use of anti-knock additives and the lowering of the compression ratio. To prevent auto-ignition, high-octane fuel—a mixture of many hydrocarbons with high-octane additives—is used in high compression engines. If knocking persists even with the use of high-octane gasoline, it is eliminated by changing the ignition time to ignite the air and fuel mixture at a lower pressure (thus at a lower compression ratio) when the piston has moved downward from its highest position. However, this lowers fuel efficiency.

Conventional methods of developing products, and specifically internal combustion engines, often lead to lengthy development cycles and consequently high cost due to the iterative nature of such methods. For example, an engine designer may make a modification to one component of an engine which, in turn, requires him to make many other modifications to other, already designed and tested components of the engine. Making such changes may require re-evaluating the previously tested components, thereby adding cost and time to the development process.

The inventors of the present invention have found that the use of an axiomatic design approach offers a workable methodology to design an engine that addresses at least some of the above-mentioned issues. Using an axiomatic design approach can provide a process for designing an engine that allows one to achieve an engine with the characteristics they want by providing a clear description of how the designer can achieve these characteristics. Once the engine designer understands the design needs, the understanding is transformed into a minimum set of specifications, which are defined as functional requirements (FR's), that adequately describe "what the designer wants to achieve" to satisfy the design needs. The descriptor of "how the designer will achieve the needs" is articulated in the form of design parameters (DP's).

A basic postulate of the axiomatic design approach used to design the internal combustion engine described herein, is that there are fundamental axioms that govern the design process. In particular, there are two primary axioms associated with the axiomatic design approach.

The first axiom is called the independence axiom. It states that the independence of functional requirements (FR's) should be maintained, where FR's are defined as the minimum set of independent requirements that characterize the design goals. A set of FR's is the description of design goals. The independence axiom states that when there are two or more FR's, the design solution should allow each one of the FR's to be satisfied without affecting the other FR's. This means an engine designer has to choose a correct set of DP's to be able to satisfy the FR's and maintain their independence.

The second axiom is called the information axiom, and it states that among those designs that satisfy the independence axiom, the design that has the smallest information content is the best design. Because the information content is defined in terms of probability, the second axiom also states that the design that has the highest probability of success is the best design.

In summary, the independence axiom requires that the functions of the design be independent (i.e. decoupled) from each other, and not that the physical parts be independent. The second axiom suggests that physical integration is desirable to reduce the information content if the functional independence can be maintained.

Conventional internal combustion (IC) engines—both spark-ignition engines and compression ignition engines (e.g., diesel)—are coupled designs from the axiomatic design point of view. Ideally, the function of the product is specified in terms of functional requirements (FRs) and constraints (C), which are satisfied exactly as specified by choosing a correct set of design parameters (DPs). When a wrong set of DPs are chosen, a coupled design results. In a coupled design, the functional requirements (FRs) of a system—e.g., engine—are not independent from each other and therefore, each time a design parameter is changed to vary one of the FR's, other FR's change, making it difficult to satisfy all FR's within the desired range. Hence, in a coupled design, FR's must be compromised to achieve a minimally acceptable performance rather than making the system behave as originally envisioned and specified to achieve the ultimate results desired.

The basic causes for coupling are different between four-stroke cycle engines and two-stroke cycle engines, and also between spark-ignition and compression ignition engines. However, in current designs, the basic functions of these engines are coupled to each other and therefore, cannot be controlled precisely. In the case of most commonly used spark-ignition engines, fuel is injected using a fuel injector into the intake manifold or inlet port (port fuel injection) outside of the combustion cylinder, which evaporates and mixes with air and flows into the cylinder during the downward stroke of the piston in the cylinder. However, part of the fuel—either in vapor or liquid phase—remains in the manifold and does not combust in the cylinder. This unburned fuel is carried out of the intake manifold when the hot combustion product is exhausted from the cylinder. When the unburned fuel mixes with the hot exhaust gas, it partially oxidizes.

Further details of the axiomatic design approach as discussed herein can be found in "The Principles of Design" by Nam P. Suh, Oxford University Press, 198 Madison Avenue, New York, N.Y. (1990), and "Axiomatic Design, Advances and Applications" by Nam P. Suh, Oxford University Press, 198 Madison Avenue, New York, N.Y. (2001) both of which-are incorporated by reference in their entirety.

SUMMARY OF THE INVENTION

In using the axiomatic design approach, the engine of the present invention has been designed such that its functional requirements are satisfied independent of one another by various design parameters. This allows design changes to be implemented easily in the engine. This also allows the engine of the present invention to achieve lower emission levels than conventional engines. Several features of various embodiments of the present invention that improve the emissions characteristics of the engine are now described. Any embodiment of the engine may include one or more of these features, independently or in combination.

In particular, the invention disclosed herein includes a decoupled engine—an engine whose functional requirements (FR's) can be satisfied independently of other FR's when the design parameters are varied. A goal is to improve the fuel efficiency as well as to eliminate (or reduce) the use of costly exhaust treatments, such as a catalytic converter. The engine has two kinds of cylinders: power cylinders (referred to as Cylinder P or PC in this write-up) where the combustion takes place, and fuel/oxidizer conditioning/mixing cylinders (Cylinder C or MC) where air and fuel vapor are mixed and homogenized. Embodiments of the present invention deliver generally the same amount of power as conventional four-stroke cycle spark-ignition engines without making the engine larger, either because the power cylinders operate with a power stroke during every crankshaft revolution in some embodiments or because the additional power that can be produced in the power cylinders more than compensates for the added weight or size of the mixing cylinders in other embodiments. It produces more complete combustion products—without the use of the catalytic converter currently used in IC engines—because substantially all the injected fuel undergoes combustion and minimal, if any, unburned hydrocarbons are exhausted. Liquid fuel, which is one of the causes for incomplete combustion, does not enter into the power cylinder, always remaining in the mixing and conditioning cylinder (Cylinder C). The general concept of the present invention can be extended to other engine configurations, including compression ignition engines (e.g., diesel) and other types of spark-ignition engines.

According to one aspect of the invention an internal combustion engine is provided. The engine comprising a cylinder block having a first cylinder and a second cylinder, a first piston disposed in the first cylinder, and adapted to reciprocate through a first swept volume for substantially completing an intake stroke and a compression stroke within the first cylinder to form a homogeneous air and fuel charge. The engine also has a second piston disposed in the second cylinder, and adapted to reciprocate through a second swept volume for substantially completing a power stroke and an exhaust stroke within the second cylinder. Furthermore, the engine has a crankshaft rotatably mounted within the cylinder block about an axis of rotation. Additionally, the engine has a first connecting rod having a first end operably coupled to the first piston and a second end operably coupled to the crankshaft such that the second end of the first connecting rod is adapted to rotate with the crankshaft about the axis of rotation. A second connecting rod is also included in the engine, the second connecting rod has a first end operably coupled to the second piston and a second end operably coupled to the crankshaft such that the second end of the second connecting rod is adapted to rotate with the crankshaft about the axis of rotation. Furthermore, a conduit in fluid communication exists between the first swept volume and the second swept volume for delivering the air and fuel charge from the first swept volume to the second swept volume. The conduit has a first portion opening into the first cylinder and a second portion opening into the second cylinder. The first portion is selectively closable for closing fluid communication between the first swept volume and the conduit. The second portion is selectively closable for closing fluid communication between the second swept volume and the conduit. The second portion is adapted to open out of phase with the first portion.

According to another aspect of the invention an internal combustion engine is provided. The engine comprising a cylinder block having a first cylinder and a second cylinder, a first piston disposed in the first cylinder, and adapted to reciprocate through a first swept volume for substantially completing an intake stroke and a first compression stroke within the first cylinder to form a homogeneous air and fuel charge. The engine also has a second piston disposed in the second cylinder, and adapted to reciprocate through a second swept volume for substantially completing at least a second compression stroke, a power stroke and an exhaust stroke within the second cylinder. The second swept volume is smaller than the first swept volume. Furthermore, the engine has a crankshaft rotatably mounted within the cylinder block about an axis of rotation. Additionally, the engine has a first connecting rod having a first end operably coupled to the first piston and a second end operably coupled to the crankshaft such that the second end of the first connecting rod is adapted to rotate with the crankshaft about the axis of rotation. A second connecting rod is also included in the engine, the second connecting rod has a first end operably coupled to the second piston and a second end operably coupled to the crankshaft such that the second end of the second connecting rod is adapted to rotate with the crankshaft about the axis of rotation. Furthermore, a conduit in fluid communication exists between the first swept volume and the second swept volume for delivering the air and fuel charge from the first swept volume to the second swept volume. The conduit has a first portion opening into the first cylinder and a second portion opening into the second cylinder. The first portion is selectively closable for closing fluid communication between the first swept volume and the conduit. The second portion is selectively closable for closing fluid communication between the second swept volume and the conduit.

According to yet another aspect of the invention, an internal combustion engine is disclosed. The engine having a cylinder block with a first cylinder, a second cylinder, and a third cylinder. A first piston is disposed in the first cylinder, and adapted to reciprocate through a first swept volume for substantially completing an intake stroke and a first compression stroke within the first cylinder to form a homogenous air and fuel charge. A second piston is disposed in the second cylinder, and adapted to reciprocate through a second swept volume for substantially completing at least a second compression stroke, a power stroke and an exhaust stroke within the second cylinder. A third piston is disposed in the third cylinder, and adapted to reciprocate through a third swept volume for substantially completing at least a third compression stroke, a power stroke and an exhaust stroke within the third cylinder. Also a crankshaft is rotatably mounted within the cylinder block about an axis of rotation. Further, a first connecting rod has a first end operably coupled to the first piston and a second end operably coupled to the crankshaft such that the second end of the first connecting rod is adapted to rotate with the crankshaft about the axis of rotation. A second connecting rod has a first end operably coupled to the second piston and a second end operably coupled to the crankshaft such that the second end of the second connecting rod is adapted to rotate with the crankshaft about the axis of rotation. A third connecting rod has a first end operably coupled to the third piston and a second end operably coupled to the crankshaft such that the second end of the third connecting rod is adapted to rotate with the crankshaft about the axis of rotation. A first conduit is in fluid communication between the first swept volume and the second swept volume. A second conduit is in fluid communication between the first swept volume and the third swept volume. Additionally, a first closable portion exists for closing fluid communication between the first swept volume and the first conduit and a second closable portion exists for closing fluid communication between the first swept volume and the second conduit.

According to an additional aspect of the invention, an internal combustion engine exists that has a cylinder block having a first cylinder, a second cylinder, and a third cylinder. A first piston is disposed in the first cylinder, and adapted to reciprocate through a first swept volume for substantially completing an intake stroke and a first compression stroke within the first cylinder to form a homogeneous air and fuel charge. A second piston is disposed in the second cylinder, and adapted to reciprocate through a second swept volume for substantially completing at least a second compression stroke, a power stroke and an exhaust stroke within the second cylinder. A third piston is disposed in the third cylinder, and adapted to reciprocate through a third swept volume for substantially completing at least a third compression stroke, a power stroke and an exhaust stroke within the third cylinder. Additionally, a first conduit provides fluid communication between the first swept volume and the second swept volume. A second conduit provides fluid communication between the first swept volume and the third swept volume. A first closable portion exists for closing fluid communication between the first swept volume and the first conduit. A second closable portion exists for closing fluid communication between the first swept volume and the second conduit. A third closable portion exists for closing fluid communication between the first conduit and the second swept volume. Additionally, a fourth closable portion exists for closing fluid communication between the second conduit and the third swept volume.

According to still another aspect of the invention, an internal combustion engine is disclosed. The engine has a pair of cylinders each having a reciprocating piston connected to a common crank shaft by a connecting rod. The rods are sized and positioned to maintain constant phase angles. One of the cylinders is adapted for an air and fuel intake and a primary compression stroke only, and the other of the cylinders adapted for at least a secondary compression stroke power and exhaust strokes only. A conduit exists for transfer of gases from the one into the other cylinder after the compression stroke. The conduit has means for isolating gases in the conduit intermediate the primary and secondary compression strokes. Furthermore, the conduit is positioned above at least a portion of the cylinders whereby any volume of liquefied fuel transferred from the one chamber to the transfer port is minimized.

Still, according to an additional aspect of the invention, an internal combustion engine is disclosed. The engine comprising a first cylinder for receiving air and fuel to be mixed in the first cylinder and compressed within the first cylinder by a first piston driven by a first connecting rod, thereby creating a compressed air and fuel charge. The engine also has a crankshaft that drives the first connecting rod, the connecting rod having an end operably connected to the crankshaft that follows a circular orbit. A chamber is in selectable fluid communication with the first cylinder and is adapted to receive substantially all of the compressed air and fuel charge while retaining any liquid fuel in the first cylinder. The chamber is further adapted to contain the compressed air/fuel charge as a first portion of a compressed air and fuel mixture and to maintain the compressed air fuel mixture at an elevated, operating pressure range. Additionally, a second cylinder is in selectable fluid communication with the chamber, and is adapted to receive a second portion of the compressed air/fuel mixture as a second compressed air/fuel charge. The second cylinder is also adapted to further compress the air/fuel charge, and to combust the second compressed air and fuel charge to drive a second piston connected to a second connecting rod. Wherein the second connecting rod has an end operably connected to the crankshaft and the second connecting rod drives the crankshaft and the end of the second connecting rod in a circular orbit.

In another aspect of the invention, a method of deriving power from combustible fuel is provided. The method comprising the steps of admixing and compressing vaporized fuel in a first chamber, into admixed gases. Then compressing the admixed gases in the first chamber and segregating the admixed gases from liquid residue in the first chamber. Thereafter isolating the admixed gases in a conduit and then transferring the admixed gases free of any significant liquids into a second chamber. Thereafter, further at least compressing the admixed gasses further in the second chamber. Igniting the admixed gases within the second chamber and then driving a piston to deliver power.

In another aspect of the invention a four cycle internal combustion engine is provided. The engine comprises a cylinder block having a plurality of cylinders formed therein. It further comprises a corresponding plurality of pistons, each disposed in a respective cylinder to define a cylinder chamber. At least one accumulator is in fluid communication with each cylinder chamber and a compressor is in intermittent communication with the at least one accumulator. An air delivery system communicates with at least the compressor to deliver air to the compressor, and a fuel delivery system communicates with at least the compressor to deliver fuel to the compressor. In this engine, the compressor compresses and mixes the air and fuel to form an air/fuel charge for subsequent delivery to the accumulator. Afterwards, the air/fuel charge is delivered from the accumulator to at least one cylinder chamber, wherein all four strokes of the engine cycle are completed.

Various embodiments of the present invention provide certain advantages and overcome certain drawbacks of prior internal combustion engines. Embodiments of the invention may not share all of the same advantages, and those that do may not share them under all circumstances. This being said, the present invention provides numerous advantages including improved emission characteristics.

Further features and advantages of the present invention, as well as the structure of various embodiments, are described in detail below with reference to the accompanying drawings.

BRIEF DESCRIPTION OF THE DRAWINGS

Various embodiments of the invention will now be described, by way of example, with reference to the accompanying drawings, in which.

DETAILED DESCRIPTION

The engine of the present invention has been conceived through an axiomatic design process, resulting in an engine that achieves improved emission characteristics. The engine is constructed to have improved emissions characteristics by addressing many of the causes of emissions found in conventional engines. The engine may include one or more features, each independently or in combination, contributing to improved emissions characteristics when the engine is in operation. Although employing a particular design process (i.e., axiomatic design) to develop the engine of the present invention, the present invention is not limited in this respect, as other design processes may be employed.

The engine comprises a mixing cylinder for mixing and compressing air and fuel, and a second cylinder for further compressing the mixture, combusting the air and fuel mixture and exhausting it from the engine. A conduit provides fluid communication between the mixing cylinder and the power cylinder for delivering the air and fuel mixture from the mixing cylinder to the power cylinder. One or more valves control the delivery of the air and fuel mixture between the cylinders. In one embodiment the valves are adapted to open and close out of phase with one another. In another embodiment, the swept volume of the power cylinder is smaller than the swept volume of the mixing cylinder. In some embodiments, the engine is adapted to prevent liquefied fuel that may exist in the mixing cylinder, from entering the power cylinder.

In another embodiment, after combustion in the power cylinder the exhaust products are expelled through an exhaust aperture while a new, compressed mixture of air and fuel is delivered to the power cylinder. The inlet and exhaust apertures of the power cylinder are adapted to remain open concurrently for a period of time so that the incoming mixture of air and fuel can assist in expelling the exhaust products. The exhaust aperture is also adapted to close, leaving a portion of the exhaust products within the power cylinder.

In yet another embodiment, the conduit acts as a pressure accumulator while providing fluid communication between a mixing cylinder and a power cylinder. The accumulator is adapted for retaining an air and fuel mixture within an elevated pressure range while the engine is in operation, thus allowing the air and fuel mixture to be delivered to the power cylinder at desired times and/or pressures.

In one embodiment, the engine has multiple power cylinders that are each adapted to receive a portion of an air and fuel mixture delivered from one mixing cylinder. Conduits provide fluid communication between the mixing cylinder and each of the power cylinders for delivering the portions of the air and fuel mixture from the mixing cylinder to the power cylinders.

Engine Cycle

Figure 1:
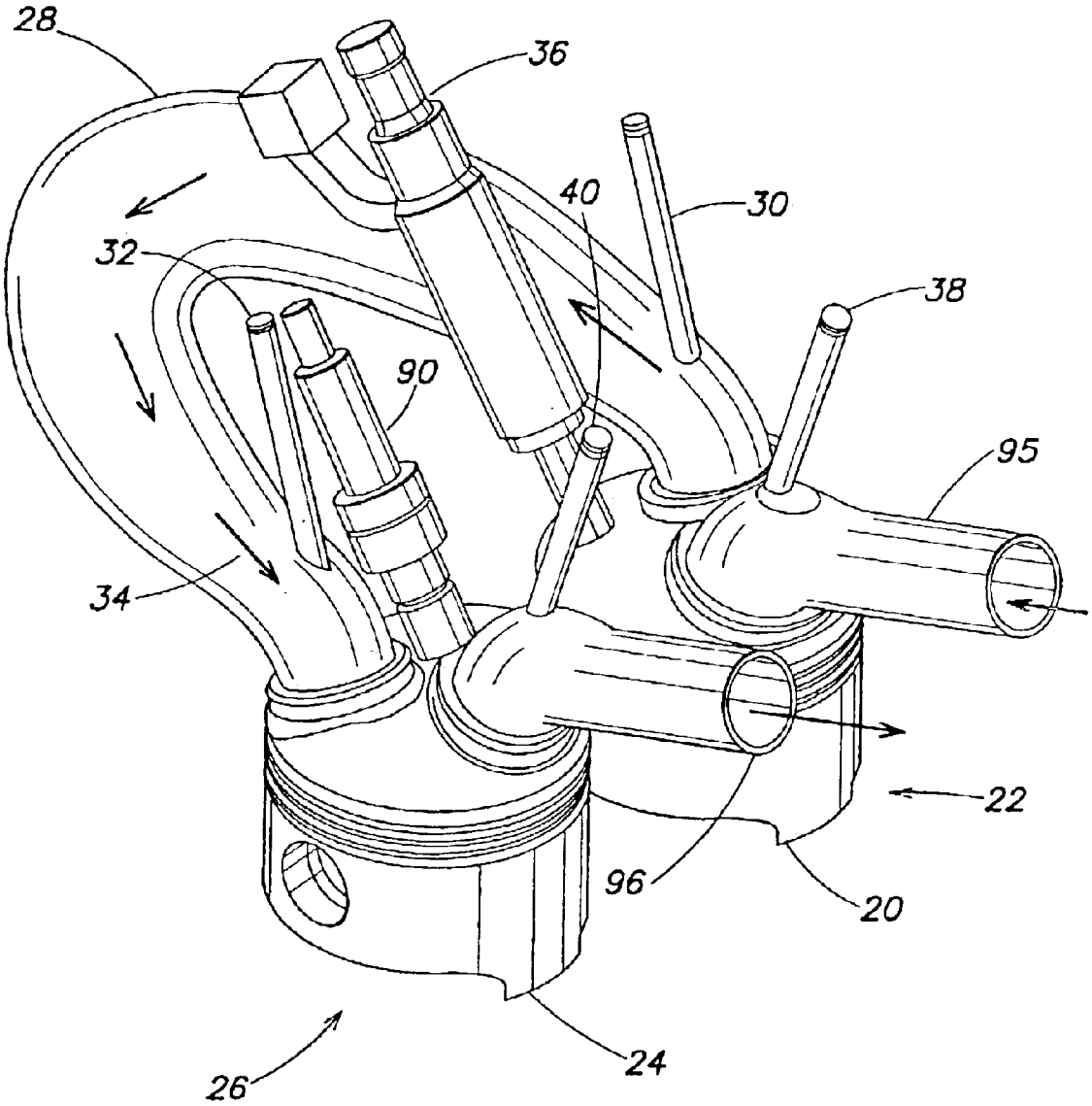
FIG. 1 is a schematic perspective view of a conduit providing fluid communication between a mixing cylinder and a power cylinder according to an aspect of the invention.
Figure 2:
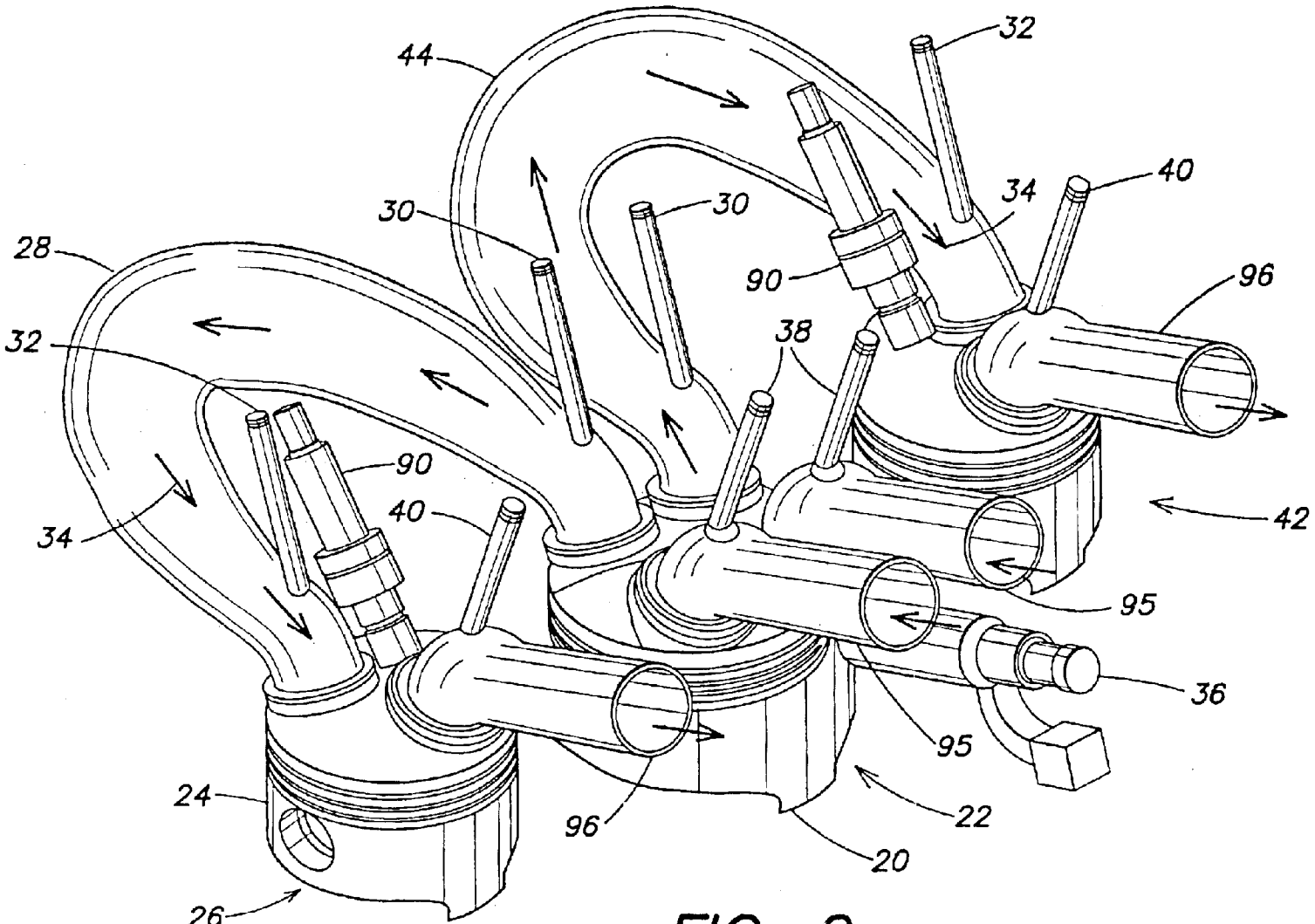
FIG. 2 is a schematic perspective view of a pair of conduits, each providing fluid communication between a mixing cylinder and one of a pair of power cylinders according to another aspect of the invention.

Turning now to the figures, and in particular, FIGS. 1 and 2, features common to many of the embodiments of the invention are shown. FIG. 1 shows a first piston 20 disposed in a mixing cylinder (not shown) through which it reciprocates, thereby defining a first swept volume. It also shows a second piston 24 disposed within a power cylinder (not shown) through which it reciprocates, thereby defining a second swept volume. A conduit 28 provides fluid communication between the mixing cylinder (MC) and the power cylinder (PC) and in many embodiments, also allows accumulation of compressed air and fuel for later delivery to the power cylinder. Transfer valves 30, 32 are located at either end of the conduit to control the flow of the air and fuel mixture 34 between the conduit and each of the cylinders. A fuel injector 36 is adapted to provide fuel into the mixing cylinder. An intake valve 38 is arranged to provide air to the mixing cylinder, and an exhaust valve 40 is arranged to allow combustion products to escape from the power cylinder. The embodiment of FIG. 2 shows an arrangement with many of the features shown in FIG. 1; however, this embodiment has an additional power cylinder arranged adjacent to the mixing cylinder 22. A second conduit 44 provides fluid communication between the second power cylinder 42 and the mixing cylinder.

The operating cycle of various embodiments of the present invention differs from the four-stroke and two-stroke operating cycles that define most engines. In a four-stroke cycle, each cylinder of the engine is used to accomplish several different functions with four separate strokes of a piston within the same cylinder, including intake, compression, power and exhaust. The intake stroke involves drawing air and/or fuel into the cylinder as the piston moves downward. The air and fuel mixture is then compressed within the cylinder as the piston moves upward. Typically just before the piston reaches top dead center (TDC) a spark ignites the compressed air fuel mixture thereby beginning the combustion process. The combusting air and fuel mixture drives the piston downward, thereby providing useful mechanical work through a rotating crankshaft that is typically connected to the piston via a connecting rod. Combustion ends as the piston nears bottom dead center (BDC) and begins moving upward. At this point, an exhaust aperture is opened allowing the combustion products to be removed from the cylinder by the piston as it travels toward top dead center. The intake valve opens again, either before or after the exhaust valve closes and the cycle repeats itself.

In a two stroke engine, the four functions described above are accomplished in two strokes. There is first an intake/exhaust stroke which occurs when the piston is near bottom dead center (BDC). Here an intake valve or other type aperture is opened, allowing a pressurized air and fuel into the cylinder. The new air and fuel mixture displaces any gases that previously existed within the cylinder such as exhaust products from a previous cycle. These gases are expelled through an open exhaust valve or other operable aperture. Once the new air and fuel mixture is located in the cylinder and the previous gases are displaced, the intake and exhaust valves are closed as the piston moves upwards towards top dead center thereby compressing the air and fuel mixture. Combustion then begins as a spark ignites the air and fuel mixtures when the piston nears top dead center. The combusting air and fuel mixture drives the piston downward, thereby providing useful mechanical work through a rotating crankshaft that is typically connected to the piston via a connecting rod. Once the piston nears bottom dead center, the intake and exhaust valves open and a new air and fuel mixture is introduced to the cylinder. The new air and fuel mixture then displaces remaining exhaust products of the previous cycle from the cylinder such that the cycle may repeat.

The general operating cycle of the present invention accomplishes the cycle of a four-stroke engine in a different manner. In a first embodiment, intake and compression occur in a mixing cylinder with a mixing cylinder piston; and intake, compression, power and exhaust occur in a power cylinder with a power cylinder piston. In a second embodiment, two of these strokes substantially occur in a mixing cylinder only, and the other two strokes occur in a power cylinder. In either embodiment the intake stroke of the mixing cylinder involves drawing air and/or fuel into the mixing cylinder as the mixing cylinder 22 piston moves downward. The air and fuel mixture is then compressed within the cylinder as the mixing cylinder 22 piston moves upward. Sometime before the piston reaches top dead center, a first transfer valve 30 opens fluid communication to a conduit 28. Substantially all of the air and fuel mixture 34 is then transferred to the conduit in a pressurized state. The transfer valve 30 closes as the mixing cylinder piston 22 nears top dead center. The intake valve 38 opens after the mixing cylinder piston reaches top dead center and begins on its downward stroke, allowing the intake and compression strokes of the cycle to be repeated within the mixing cylinder. Although intake and compression occurs in a mixing cylinder, other compression arrangements, such as pumps, turbo chargers, super chargers and the like may be used.

In the first embodiment, at a desired time a second transfer valve 32 opens fluid communication between the conduit 28 and the power cylinder 26. The compressed air and fuel mixture 34 is then transferred from the conduit to the power cylinder as the power cylinder piston is on its downward stroke. The valve 32 between the conduit and the power cylinder closes before the power cylinder piston has traveled very far on its next upward stroke if not before the power cylinder piston begins its upward stroke. Additional compression is then imparted to the air and fuel mixture within the power cylinder. This compression that occurs in the mixing cylinder, coupled with the homogenization of the air and fuel mixture allows higher compression to occur within the power cylinder. A spark 46 ignites the compressed air and fuel mixture in the power cylinder as the piston nears top dead center thereby beginning the combustion process. The combusting air and fuel mixture drives the power cylinder piston 24 downward, thereby providing useful mechanical work through a rotating crankshaft 48 that is typically connected to the piston via a connecting rod 50. Combustion ends as the power cylinder piston nears bottom dead center and then begins moving upward. Near bottom dead center, an exhaust aperture 40 is opened allowing the combusting products to be removed from the power cylinder by the piston as it travels toward top dead center. The transfer valve 32 between the conduit and power cylinder opens again, either before or after the exhaust valve closes. The intake, compression, power, and exhaust strokes of the cycle are then repeated within the power cylinder.

In the second embodiment, at a desired time, a second transfer valve 32 opens fluid communication between the conduit 28 and the power cylinder 26. The compressed air and fuel mixture 34 is then transferred from the conduit to the power cylinder as the power cylinder piston is on its upward stroke. This allows the air and fuel mixture to remain within an elevated operating pressure range as it is transferred to the power cylinder. The valve 32 between the conduit and the power cylinder closes before the power cylinder piston reaches top dead center and then a spark 46 ignites the compressed air fuel mixture thereby beginning the combustion process as in the first embodiment. The combusting air and fuel mixture drives the power cylinder piston 24 downward, thereby providing useful mechanical work through a rotating crankshaft 48 that is typically connected to the piston with a connecting rod 50. Combustion ends as the power cylinder piston nears bottom dead center and then begins moving upward. Near bottom dead center, an exhaust aperture 40 is opened allowing the combustion products to be removed from the power cylinder by the piston as it travels toward top dead center. The transfer valve 32 between the conduit and power cylinder opens again, either before or after the exhaust valve closes. The power and exhaust strokes of the cycle are then repeated within the power cylinder.

Steps of Engine Operating Cycle

Figure 3A:
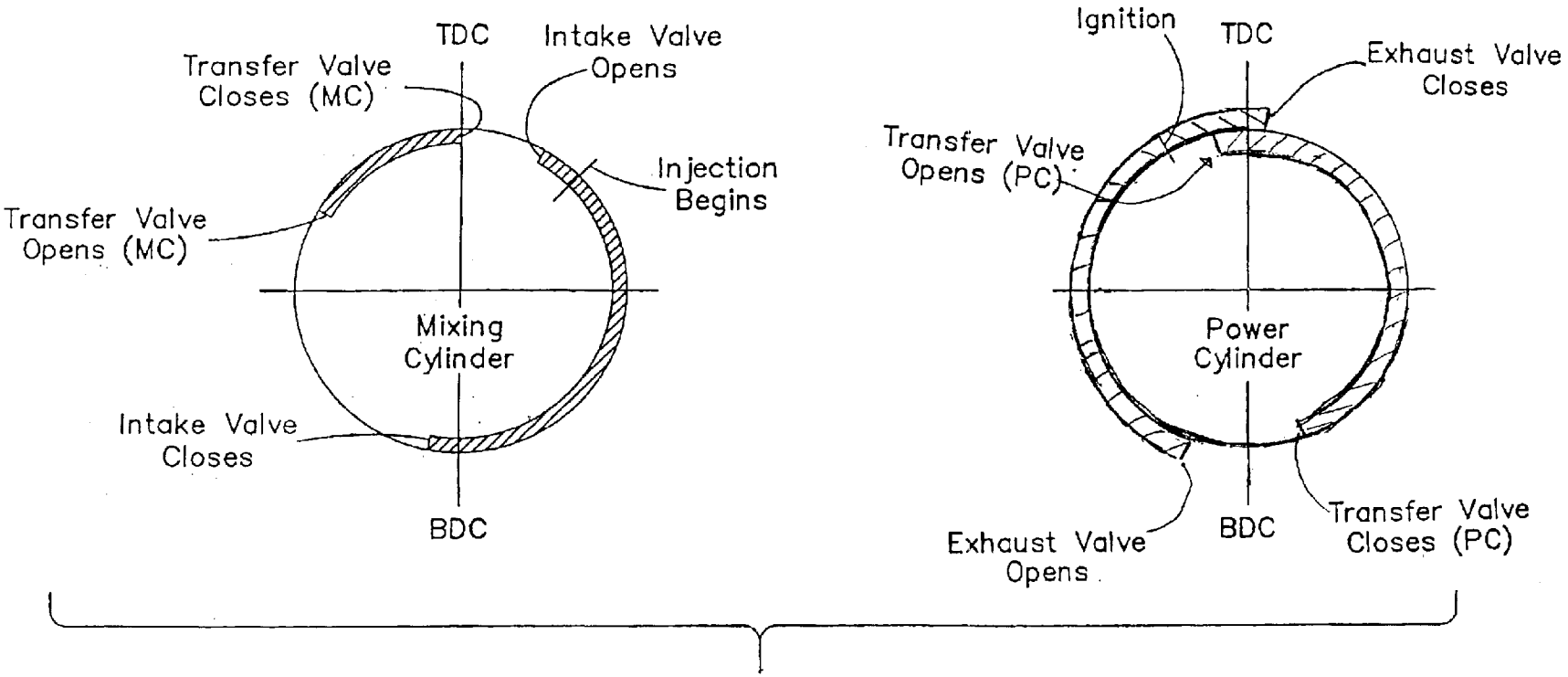
FIGS. 3*a*–3*d* show an engine cycle diagram for embodiments of the invention with a mixing cylinder piston moving in various constant phase relationships with a power cylinder piston where the power cylinder operates in a four-stroke mode.
Figure 3B:
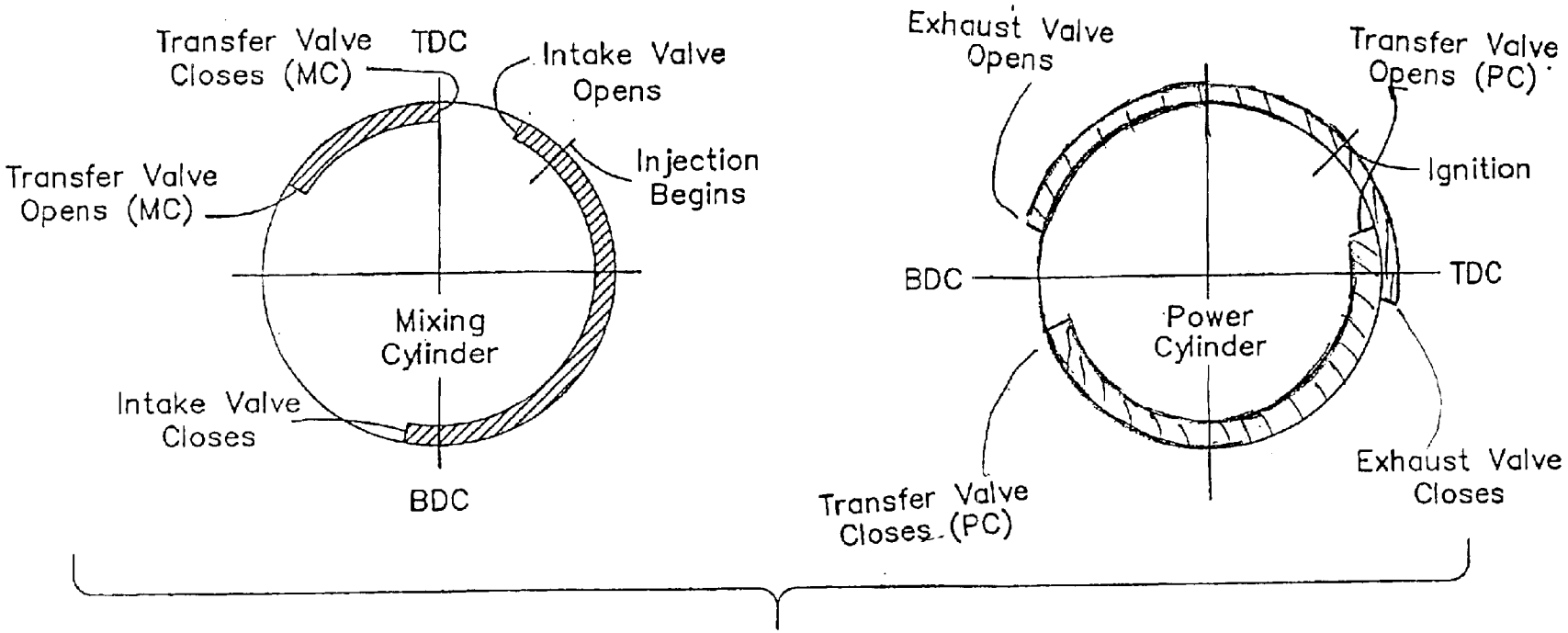
Figure 3C:
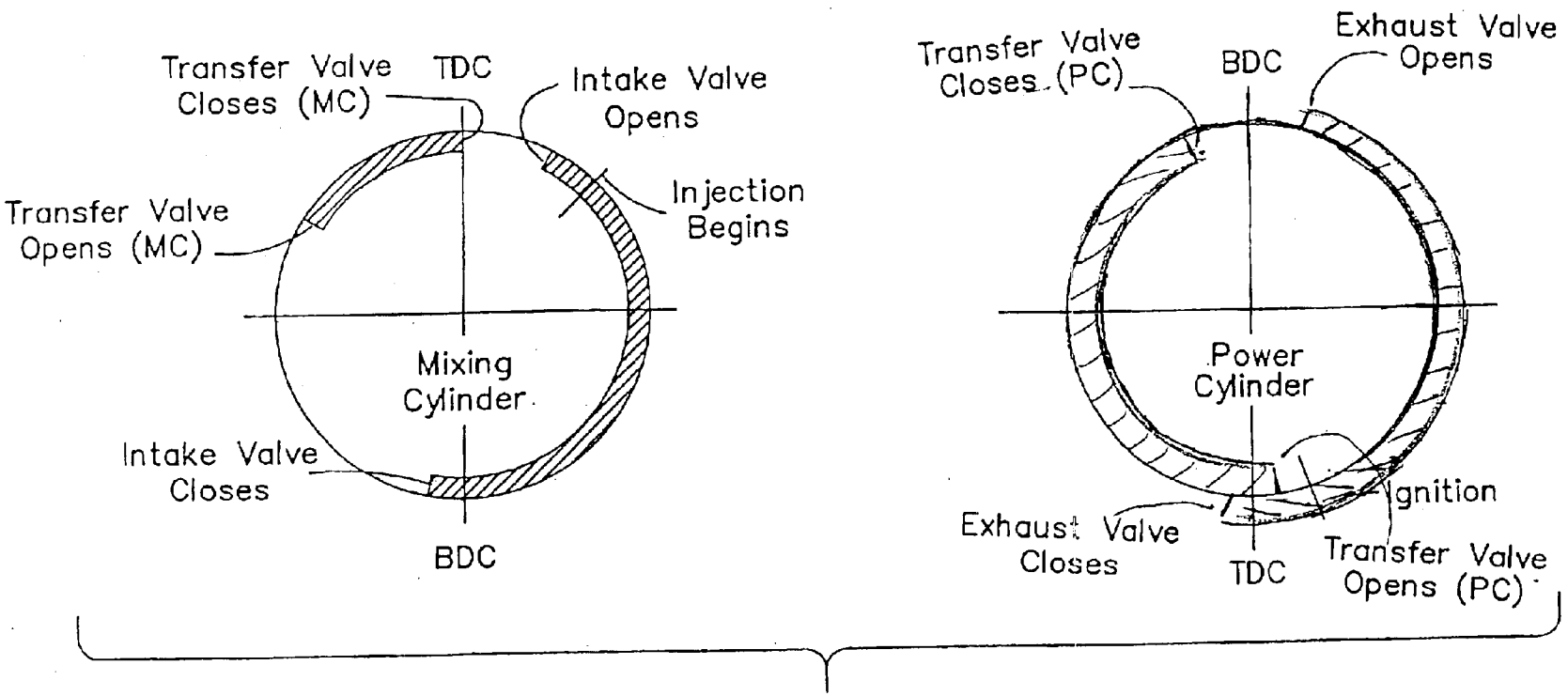
Figure 3D:
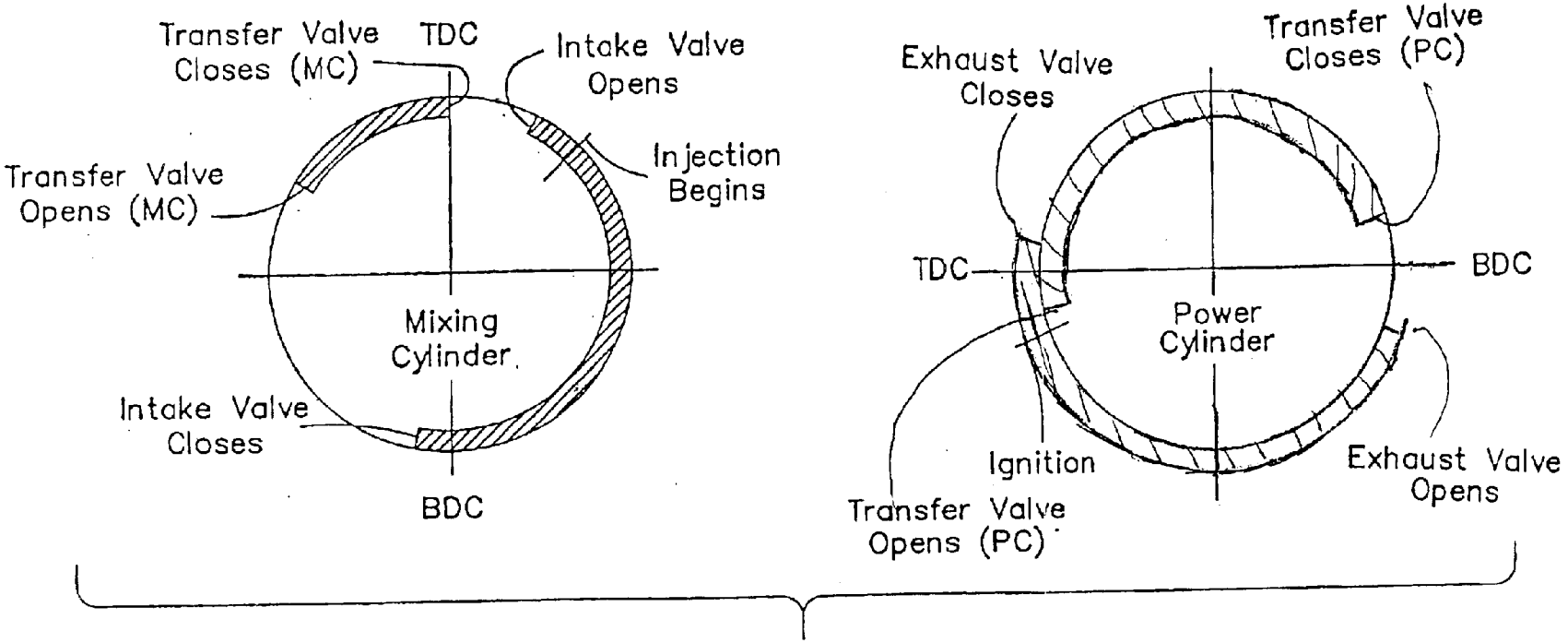

The engine cycles and the engine structures are now described in more detail with respect to the particular embodiment of the engine cycle represented in FIG. 3*a*. In particular, FIG. 3*a* describes the motions of the pistons and valves associated with both the mixing cylinder and the power cylinder according to one aspect of the invention when four strokes, including intake, compression, power, and exhaust occur in the power cylinder. FIGS. 4*a*–4*j* show the motions of the pistons, valves and the air and fuel mixture at various points throughout the cycle defined in FIG. 3*a*. In this particular embodiment, the pistons of both the mixing cylinder and the power cylinder move in phase with one another although other arrangements are possible, some of which are represented by FIGS. 3*b*–3*d*. It is noted that FIGS. 4*a*–4*j* show the mixing cylinder piston and the power cylinder piston as being attached to separate crankshafts. However, in one embodiment, the pistons are connected to the same crankshaft via connecting rods, as the present invention is not limited in this respect. It is noted that in this depiction of an embodiment where two strokes (intake and compression) occur in the mixing cylinder and four strokes (intake and compression, power, exhaust) occur in the power cylinder, that the representation of the motions in the mixing cylinder one duplicated between FIGS. 4*a*–4*e* and FIGS. 4*f*–4*j* to allow a complete view of the four strokes in the power cylinder.

Intake

Figure 4A:
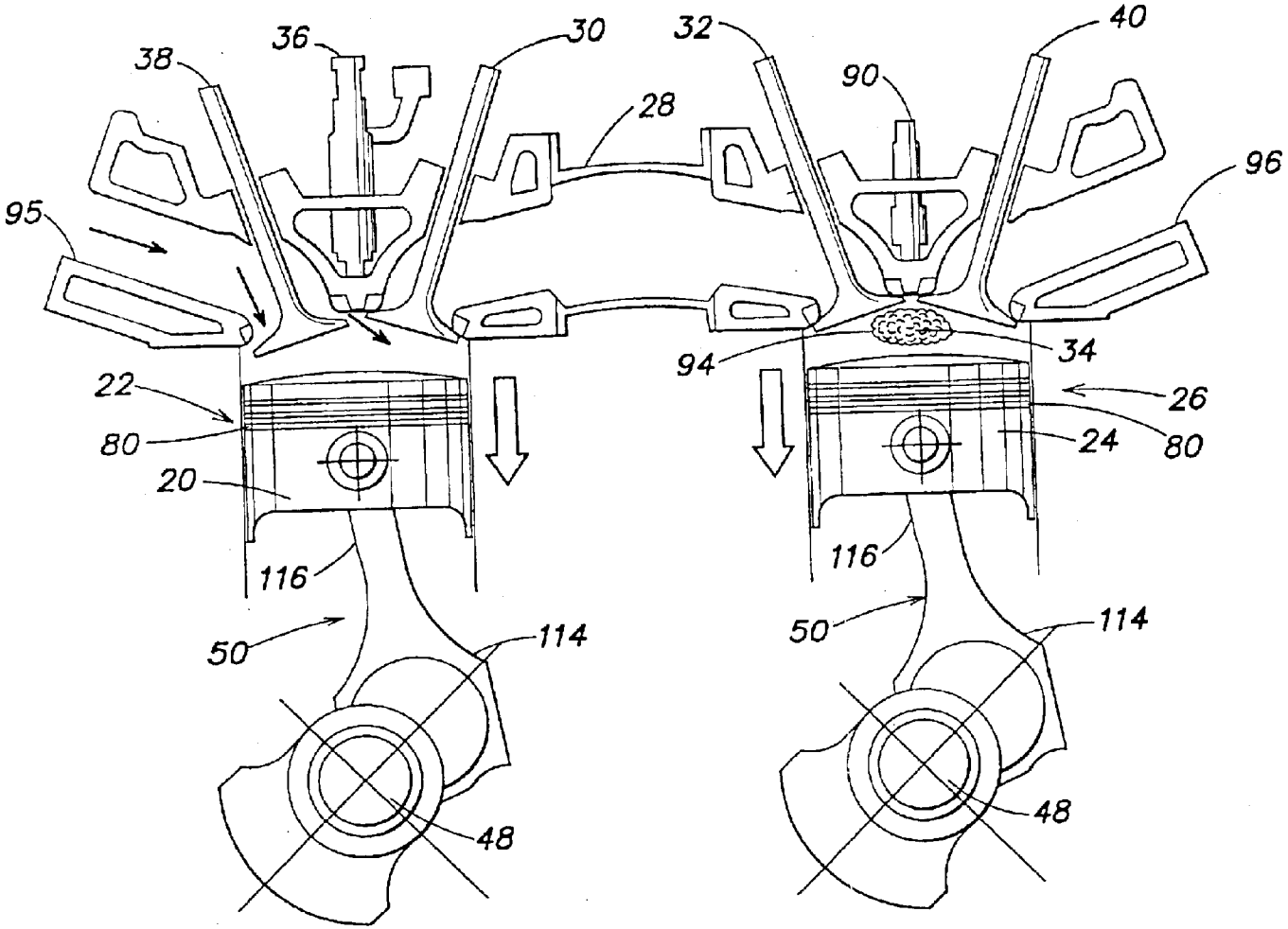
FIGS. 4*a*–4*j* are schematic representations of an engine at various steps of an engine cycle with a mixing cylinder piston moving in phase with a power cylinder piston where the power cylinder operates in a four-stroke mode.
Figure 4B:
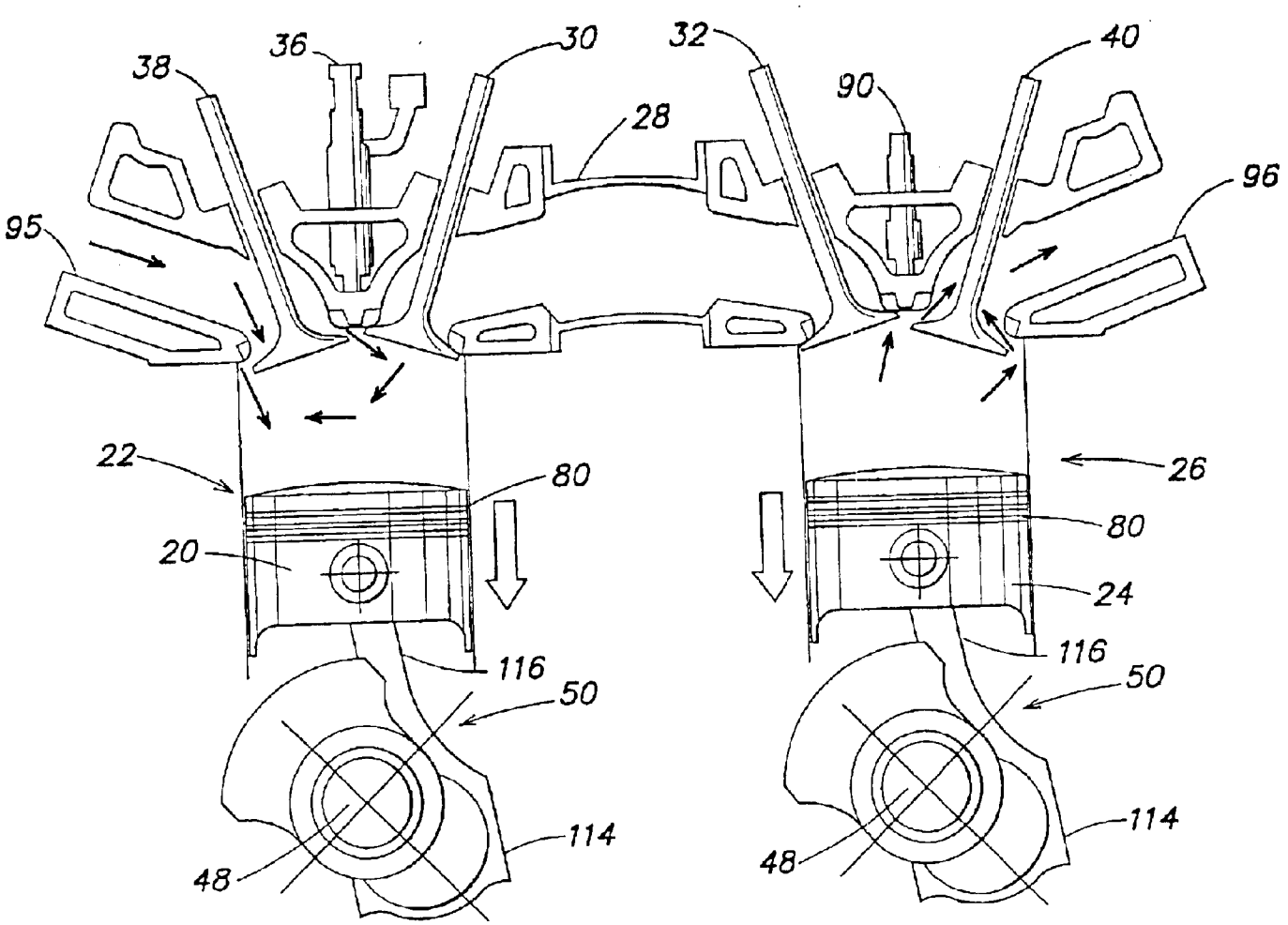

The operating cycle of FIGS. 3*a* and 4*a*–4*j* is now be described beginning with the motions of the mixing cylinder. The mixing cylinder piston, as shown in FIG. 4*a* is approximately 45 crank angle degrees after it has descended from its top dead center position. At this point, the downward motion of the piston has created a reduced pressure zone within the mixing cylinder. This reduced pressure allows air to be drawn into the mixing cylinder through the intake valve that opens at approximately 30 degrees after top dead center. The mixing cylinder will draw in a substantially similar volume of air during each engine cycle in most embodiments. In some embodiments, the volume of the mixing cylinder swept volume may be increased to improve the volumetric efficiency of the engine. In particular, it may be larger than the swept volume of the power cylinder. Alternatively, in other embodiments, air could be pushed into the cylinder by peripheral components such as turbochargers, superchargers, ram air devices or other suitable means as the invention is not limited in this respect. In these scenarios, the amount of air drawn into the mixing cylinder may vary between cycles. Air continues to enter the mixing cylinder, as is shown in FIG. 4*b*, until the mixing cylinder piston nears bottom dead center. In particular, the embodiment of FIG. 3*a* has the intake of air continuing until 10 degrees (crank angle) past bottom dead center when the intake valve closes. While the intake cycle of the mixing cylinder has been described with respect to an embodiment operating with four strokes in the power cylinder, a similar intake cycle may be present in embodiments operating with only two strokes in the power cylinder.

Fuel Delivery

Figure 4C:
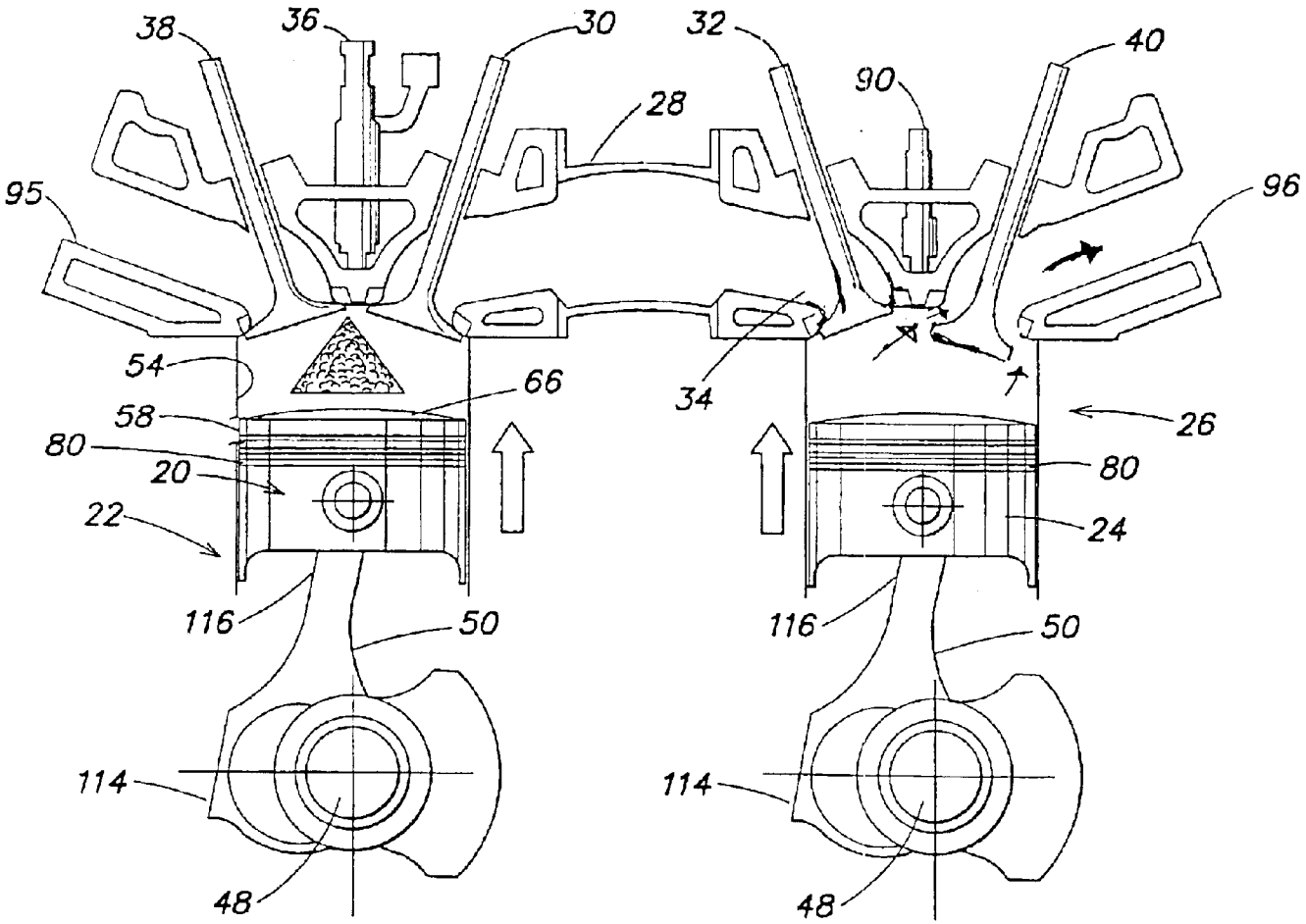
Figure 4D:
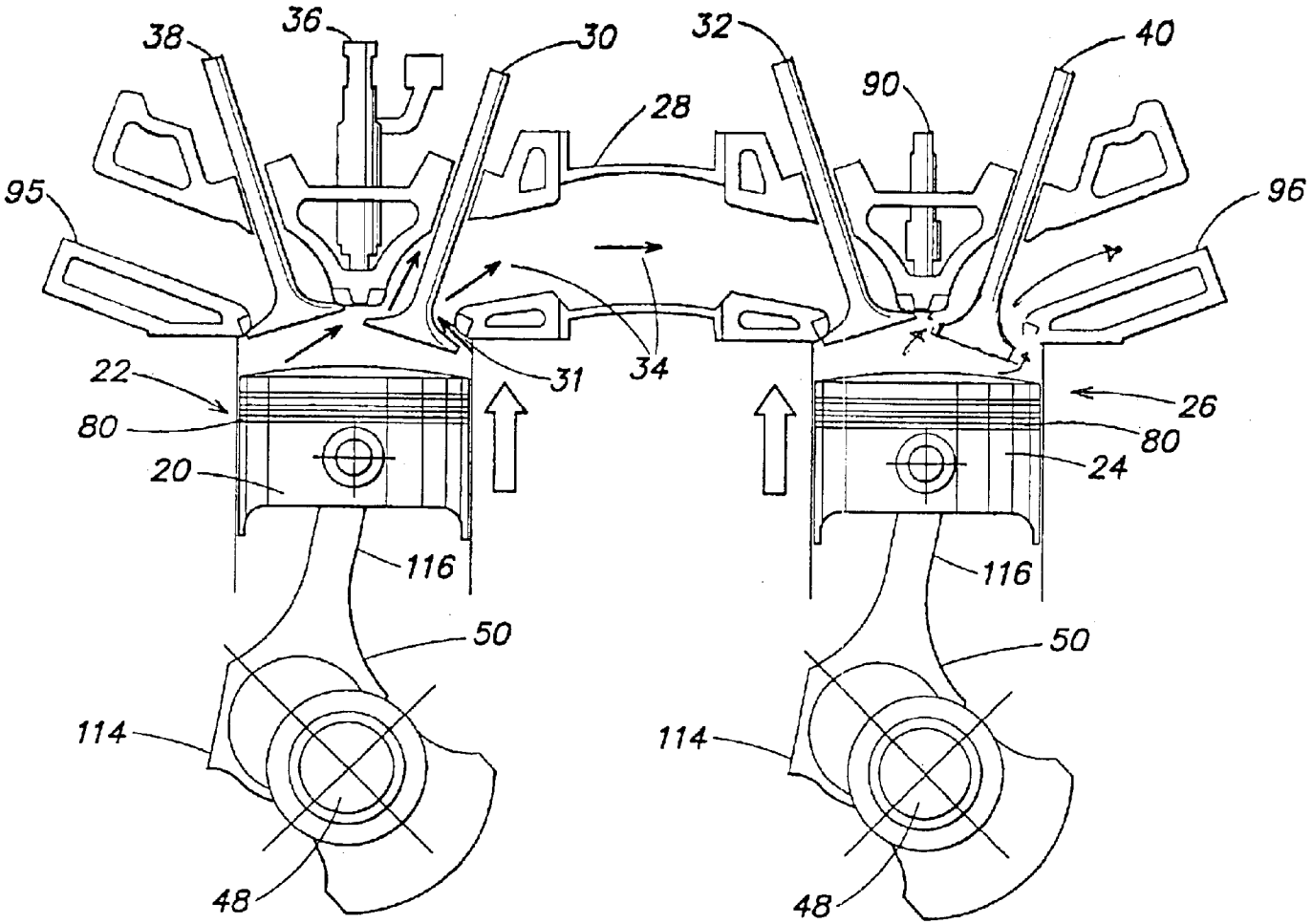
Figure 4E:
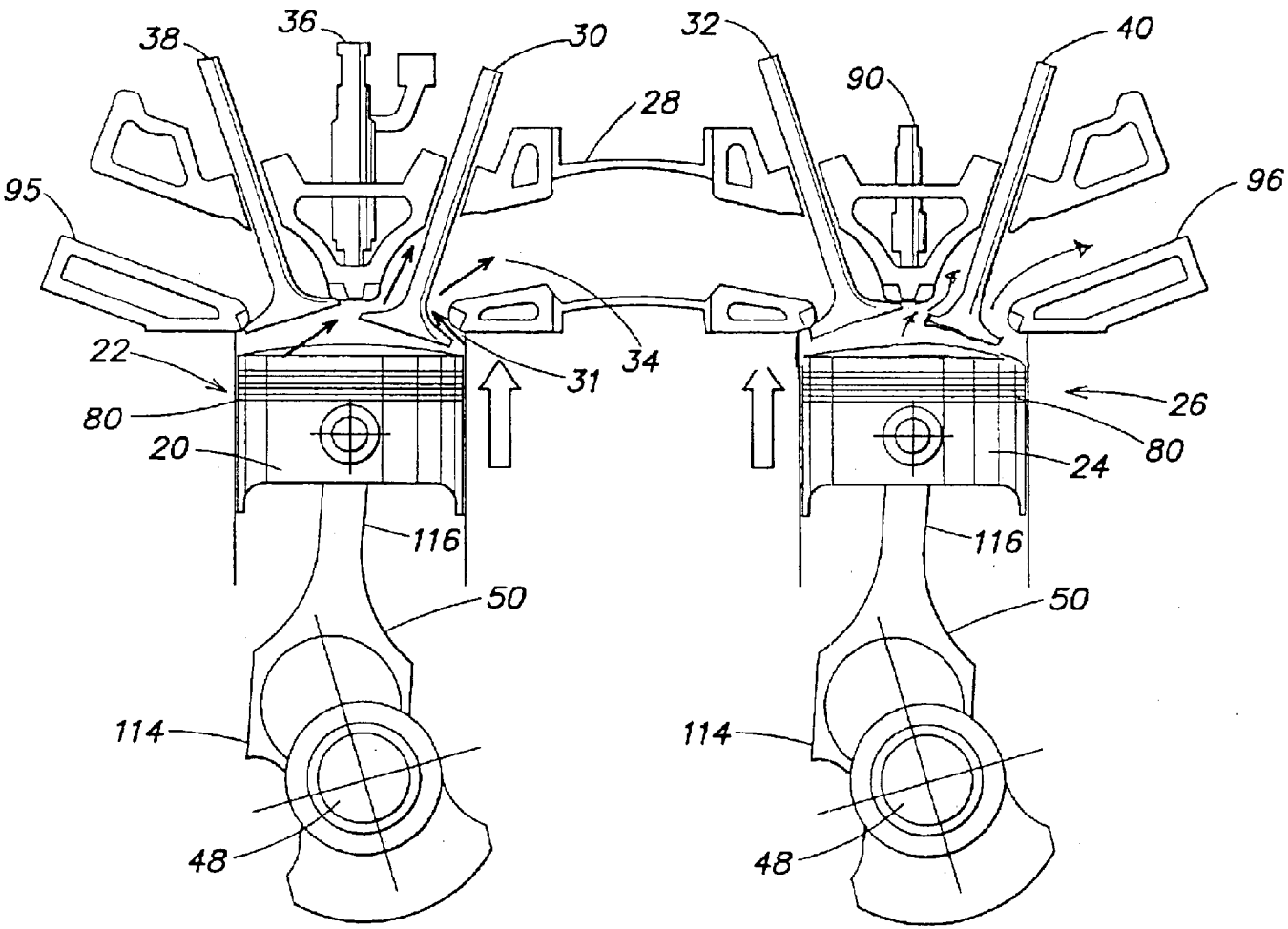

Fuel may be injected into the mixing cylinder during the air intake process with a low pressure fuel injector. Fuel injection is shown to begin between 40 and 60 degrees after top dead center in the cycle diagram of FIG. 3*a*. However, FIGS. 4*c* and 4*h* depict fuel being delivered with a high pressure fuel injector well after the mixing cylinder piston has reached bottom dead center and is returning toward top dead center as the invention is not limited in this respect. To deliver fuel, as shown in FIGS. 1–2, and 4*a*–4*j*, a fuel injector is used to directly deliver fuel into the mixing cylinder, although other embodiments may incorporate different types of fuel delivery systems such as carburetors, port fuel injectors, indirect fuel injectors, gaseous fuel injectors or other suitable fuel delivery systems as the invention is not limited in this respect. In some embodiments, fuel is injected substantially orthogonally into air that is flowing into the mixing cylinder. Injecting fuel in this manner helps promote evaporation and mixing. In other embodiments, multiple fuel injections from one or more injections may be used as well.

Fuel delivery continues until the desired amount of fuel has been injected into the mixing cylinder. Operating conditions of the engine at any given moment may determine how much fuel is required. For instance, if more air is delivered to the mixing cylinder, then more fuel will be required to maintain a similar air to fuel ratio within the mixing cylinder. In many embodiments, more air and fuel is allowed into the cylinder when the engine requires more power. The amount of air provided to the cylinder may be controlled by a throttling device within the intake system of the engine. In other embodiments, peripheral devices such a turbochargers, superchargers and/or ram air devices may also affect the amount of air provided to the mixing cylinder and thus affect the amount of fuel required. While the strategy behind the present invention is generally to operate with an air fuel mixture near the stochiometric value, there may be certain scenarios where altering the air/fuel ratio is desired, as the present invention is not limited in this respect. For instance, some embodiments of the invention may regularly draw substantially the same amount of air into the mixing cylinder during every engine cycle. In such embodiments as well as other, the torque output of the engine and/or the operating speed of the engine can be changed by altering the air/fuel ratio of the engine. Operating the engine with a rich air and fuel mixture may increase the engine torque and/or engine speed while operating the engine with a lean air and fuel mixture may decrease the engine torque and/or engine speed.

Fuel and Air Mixing

Fuel and air homogenization is promoted by various features and aspects of the mixing cylinder as un-evaporated fuel or non-homogenized air and fuel mixtures can cause incomplete combustion and hydrocarbon emissions. A fuel delivery system that atomizes most of the fuel as it is delivered into the mixing cylinder helps evaporate fuel and homogenize the mixture. However, some of the injected fuel may impinge the walls 54 of the cylinder, and form a liquid fuel film. Liquid fuel may also be trapped between the outer cylindrical walls 58 of the piston and the cylinder walls 54. Such liquid fuel typically causes incomplete combustion and hydrocarbon emissions in a conventional engine. However, if liquid fuel resides within the mixing cylinder of the present invention, it will remain in the mixing cylinder until it evaporates. Some embodiments of the invention may include a receptacle in the piston crown for retaining liquid fuel until it can evaporate. Furthermore, the environment of the mixing cylinder is maintained at a temperature that promotes the rapid evaporation of fuel within the mixing cylinder. For one embodiment operating at 3,500 revolutions per minute, a temperature of 500 K accomplishes this effect.

The mixing cylinder may also include other features such as turbulators placed at various positions within the cylinder to promote the evaporation and homogenization of the air and fuel mixture through turbulent air motions within the cylinder. These turbulators may include structures placed near the valve port 95, on the crown 66 of the piston, on the firedeck 64 of the cylinder head or in any other suitable location as the invention is not limited in this respect. The fact that combustion does not occur within the mixing cylinder provides a wide degree of freedom in designing turbulators, which are often designed to endure the rigors of a combustion environment in conventional engines.

The mixing cylinder may also incorporate mixing features that might otherwise be subject to combustion pressures and temperatures in a conventional engine. Active mixing devices, such as a mixing fan disposed in the crown of a piston or on the firedeck of the cylinder head may be included within the mixing cylinder to promote fuel evaporation and mixture homogenization. Such a mixing fan may comprise a rotor that actively moves air and fuel about the mixing cylinder. The active mixing fan can be driven by fluids powering to a separate drive rotor that is disposed outside of the mixing cylinder and connected to the fan via a shaft. Fluids such as engine oil, engine coolant, or any other suitable fluids may serve to rotate the drive rotor, which in turn rotates the mixing fan. Alternatively, the reciprocating motion of the piston, an electric drive system or even a magnetic drive system between the fan and the walls of the cylinder may serve to drive the active mixing device. In some embodiments, the mixing fan may be heated by various engine fluids, or even electrically, to improve fuel evaporation. Other suitable drive means may be employed as the present invention is not limited in this respect.

Compression

Returning now to FIGS. 4*c* and 4*h*, where the air and fuel mixture is shown to be compressed after the intake valve 38 closes and the piston 20 begins moving upward toward top dead center. The compression stroke continues until a first transfer valve 30 opens fluid communication between the mixing cylinder 22 and a conduit 28. This occurs from approximately 60 degrees before top dead center until top dead center in the embodiment represented by FIGS. 4*d* and 4*i*, although other opening times, closing times, and delivery durations are possible as the invention is not limited in this respect. Substantially all of the air fuel mixture 34 is then transferred to the conduit or accumulator 28 through the aperture 31 of the conduit as is depicted in FIGS. 4*d*, 4*e*, 4*i* and 4*j*. This transfer, as depicted, is timed to substantially prevent any back flow of gases into the mixing cylinder. Substantially complete transfer of the homogenized air and fuel mixture is possible in embodiments with very little clearance volume in the mixing cylinder.

It is noted that the aforementioned aspects and features that promote evaporation and homogenization within the mixing cylinder 22 also reduce the possibility of transfer of liquid fuel to the conduit 28. However, should any portion of the fuel not evaporate before the air and fuel mixture is delivered to the conduit 28, the fact that the aperture 31 to the conduit is located near the top of the mixing cylinder will further prevent the liquid fuel from entering the conduit. Additionally, injected, liquid fuel droplets will tend to contact the mixing cylinder walls and the piston due to their greater weight, and thus greater momentum. Then, the liquid droplets will likely stick to the wall or piston due to surface tension until they have an opportunity to evaporate. Furthermore, some embodiments may include additional features in or near the entrance to the conduit to insure that liquid fuel is retained in the mixing cylinder. One of such features is a mesh screen placed near the aperture 31 between the mixing cylinder 22 and the conduit 28. Should any liquid fuel be carried toward the conduit, it will likely impact the screen and be removed from the air before it passes into the conduit. A tortuous passageway can also be placed between the mixing cylinder and conduit to serve a similar function. Additionally, other features that further insure that liquid fuel does not enter the conduit may also be incorporated into the engine as the invention is not limited in this respect.

The mixing cylinder 22 of the various embodiments of the invention is not required to contain hot, combusted gases. As a result, numerous advantageous features can be incorporated into the mixing cylinder. For instance, the sealing mechanisms 80 that typically exist between the outer cylindrical surface 58 of the piston 20 and the inner wall 54 of the cylinder do not have to contain hot, extremely high pressure gases during combustion. Therefore, they can be manufactured from materials that are less expensive, and/or materials that present less frictional resistance to the movement of the engine. Additionally, the surfaces of the cylinder wall may comprise undulated surfaces to reduce frictional drag between the piston and cylinder. Such surfaces reduce the work required of the engine to compress air and fuel within the mixing cylinder and/or ultimately allow for a more efficient engine.

Another benefit realized by the use of a separate mixing cylinder 22 is that less heat needs to be removed from the mixing cylinder environment. Many embodiments of the invention include features such as an engine coolant jacket that surrounds the mixing cylinder to help maintain its temperature. However, they do not need to remove as much heat as they would in a conventional engine. As a result of lower temperatures the cylinder may be made of a much lighter weight material, and/or a material that does not need to withstand extremely high temperatures typically associated with combustion, such as some aluminum alloys.

The mixing cylinder 22 may also have a much higher compression ratio than a typical cylinder due to temperatures in the mixing cylinder being lower than those of most conventional combustion chambers. Compression ratio is defined as the volume within the cylinder when the piston is at bottom dead center over the volume in the cylinder when the piston is at top dead center. Most compression ratios of typical engines cannot be too high because an air and fuel mixture may autoignite if compressed too much in a hot environment that exists in the cylinder, as is often the case for a cylinder that supports combustion. Such auto-ignition can cause "knocking' in a spark-ignition engine, as is discussed later.

Accumulation

Figure 7:
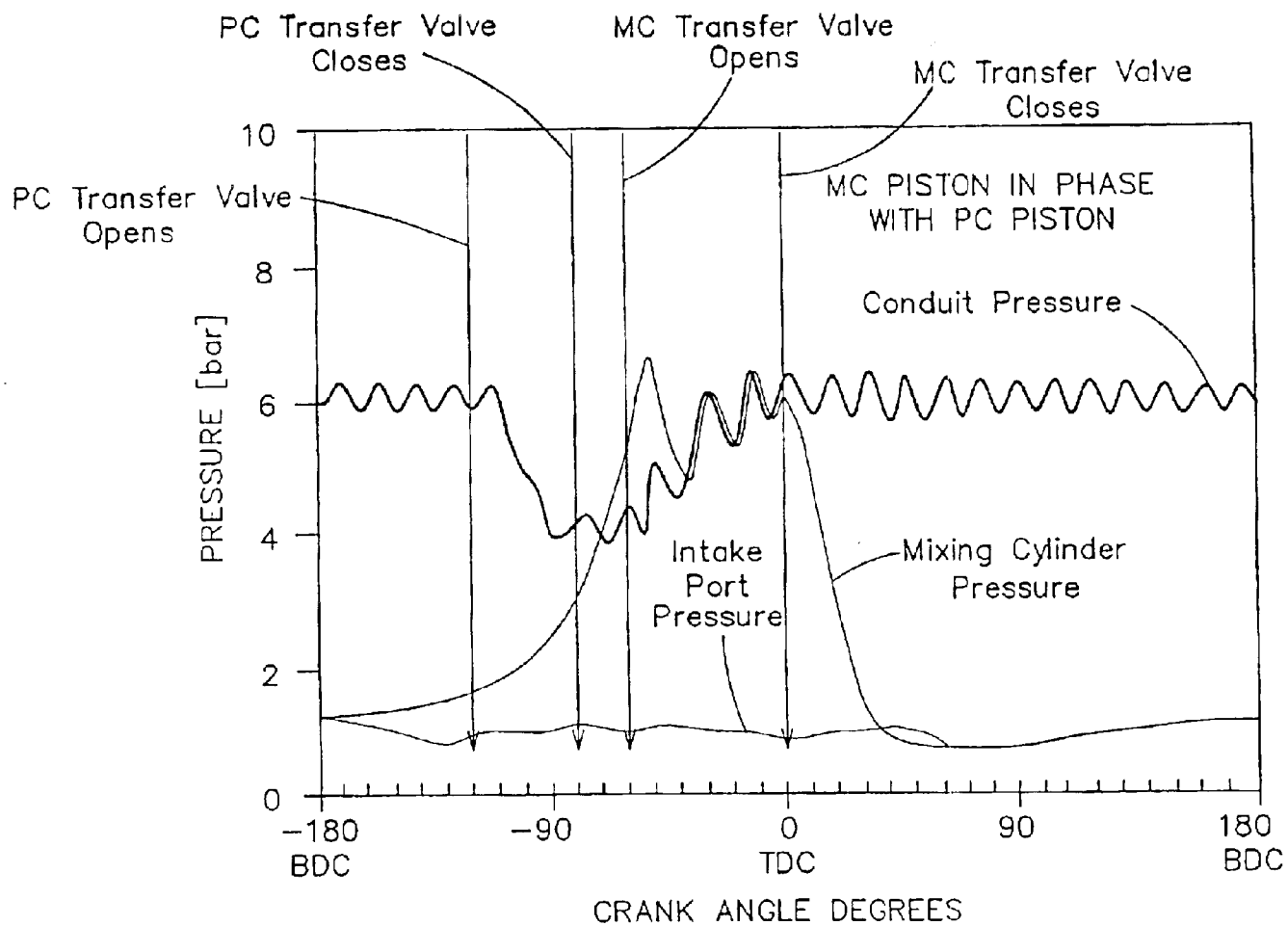
FIG. 7 is a pressure plot for a mixing cylinder and a conduit of an engine with a mixing cylinder piston moving in phase with a power cylinder piston where the power cylinder operates in a two-stroke mode.

The pressure level in the conduit is raised as the air and fuel mixture is delivered from the mixing cylinder 22. The conduit 28 is typically maintained within an elevated, operating pressure range except for certain conditions where the conduit may be under substantially atmospheric pressure, such as during initial engine starting or during some transient operation modes. The pressure levels of both the mixing cylinder and the conduit are depicted in FIG. 7 for an embodiment of the engine operating at 3500 revolutions per minute with the mixing cylinder piston and a power cylinder piston moving in phase. This embodiment also has a base diameter of 158 mm, a stroke of 42 mm, the compression ratio of the mixing cylinder is 20:1 and the compression ratio of the power cylinder is 9:1. In this embodiment and at this engine speed, the conduit maintains an elevated, operating pressure between 4 and 6 bars, although other suitable pressures may be employed as the present invention is not limited in this respect. The embodiment shown in FIG. 7 has a power cylinder operating with only power and exhaust strokes. However, a different pressure curve having greater maximum pressures may be realized in some embodiments having a power cylinder operating with four strokes.

The air and fuel mixture 34 delivered to the conduit 28 may exist in the conduit along with a portion of an air and fuel mixture that was delivered in a previous cycle or cycles. In this sense, the conduit 28 can act as a accumulator that collects homogenized air and fuel mixtures 34 and holds them in the accumulator within a substantially elevated operating pressure range. In one embodiment, the conduit 28 defines a volume substantially equal to the swept volume of the mixing cylinder 22. This allows the conduit to retain several times the amount of air delivered during one cycle of the engine, if desired. However, conduits defining larger or smaller volumes may be employed as the present invention is not limited in this respect.

Valves found in conventional engines typically only have to hold a pressurized gas within a cylinder. However, the valves 30, 32 at either end of the conduit 28 in the present invention are required to hold a pressurized gas within the conduit, as well as within their respective cylinders. Although the pressure within the conduit is generally lower than the pressure within the mixing cylinder 22, and substantially lower than the peak pressures witnessed in a power cylinder 26, some modifications may be made to the valves to help them close fluid communication. These changes may include increasing the valve spring strength to provide a greater closing force, and/or making the valves out of a much lighter material such as titanium. Lighter materials such as titanium may also improve valve train dynamics and even help prevent valve surge in some embodiments. This can be particularly helpful in embodiments that have rapid valve motions.

Still other embodiments may replace the valves as shown in FIGS. 4*a*–4*j* with rotary-type valves. Such rotary valves may comprise a shaft placed through the interface between the conduit and either of the cylinders, between either of the cylinders and their respective intake and/or exhaust ports or within the conduit itself. Such a shaft may have a cylindrical aperture drilled transversely through the shaft, the valve opening fluid communication when this aperture is aligned with the ports and closing fluid communication when it is not aligned with the ports.

The presence of the conduit 28 between mixing cylinder 22 and power cylinder 26 allows the engine to effectively have a variable compression ratio. In a conventional engine the compression ratio determines what pressure the air fuel mixture 34 will have when it is in a fully compressed state near the beginning of combustion. This is, generally a fixed value in a conventional engine. However, the conduit 28 of the present invention acting as an accumulator can take on various different pressure levels as desired by the engine controller. In some embodiments, particularly those with solenoid actuated valves or other valves that may be adjusted during operation, the compression ratio or effectively the pressure at which the air fuel mixture is delivered to the power cylinder 26 prior to combustion may be varied according to the engine operating parameters.

Delivery of Air and Fuel Mixture to Power Cylinder

Figure 4F:
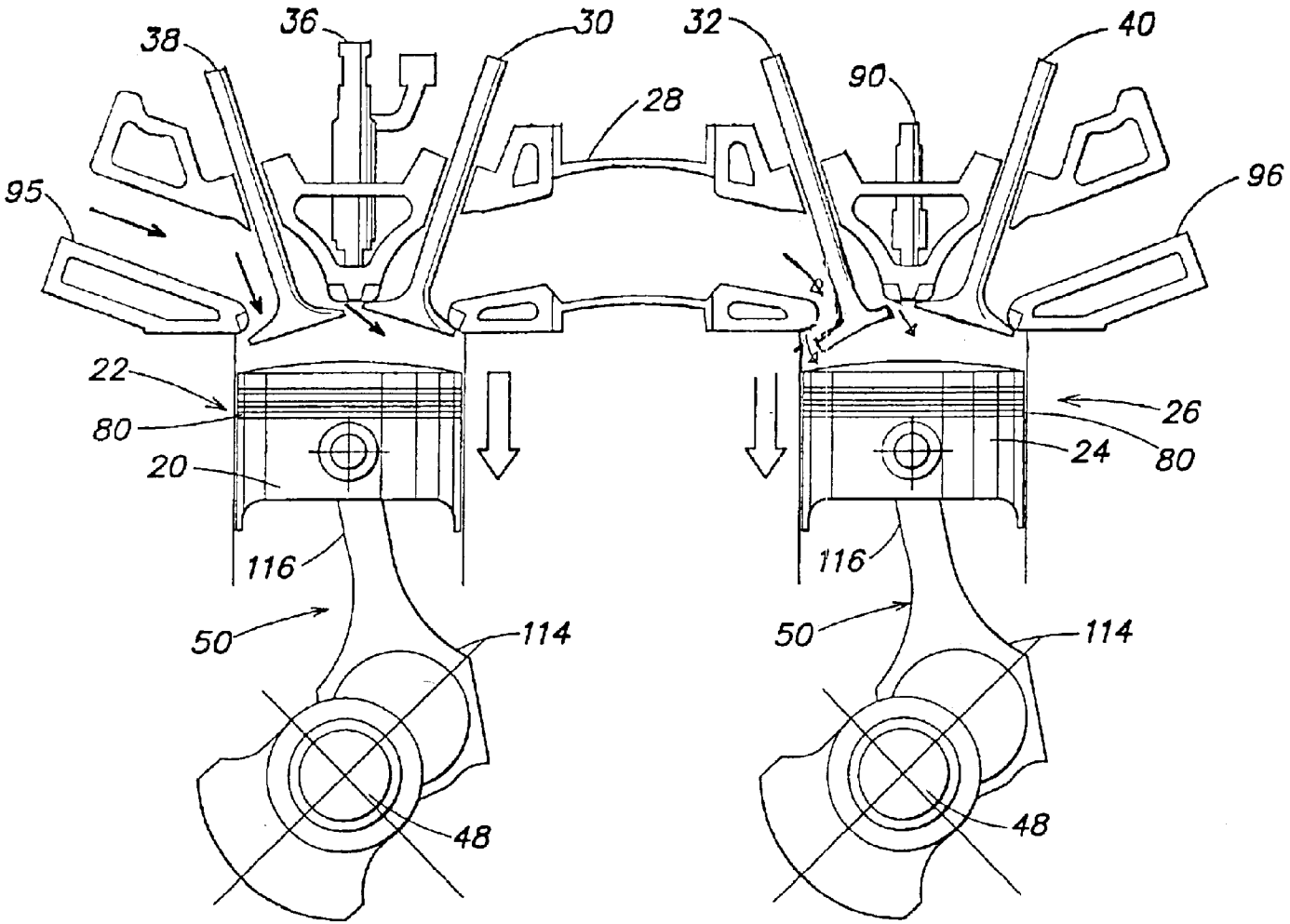
Figure 4G:
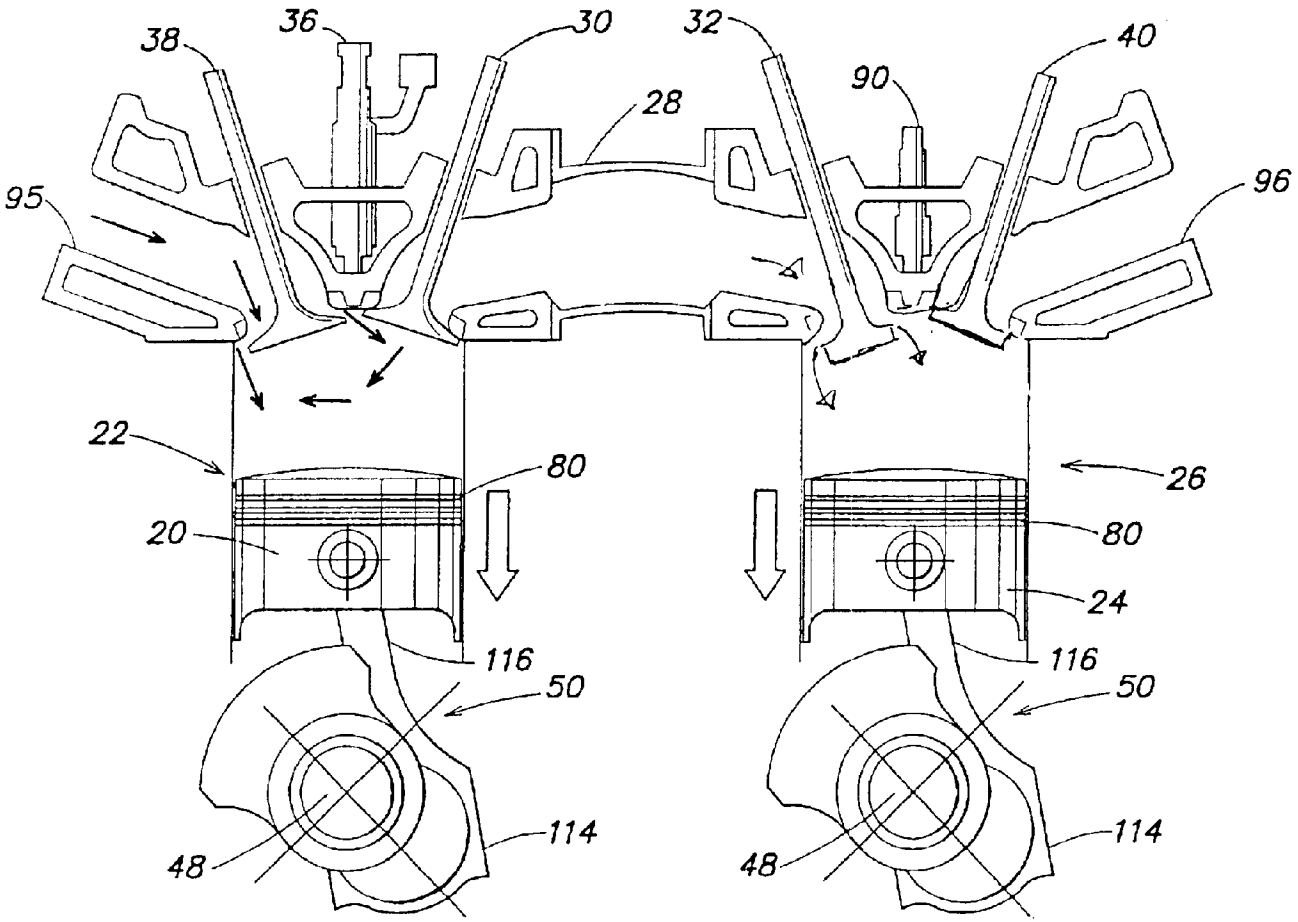
Figure 4H:
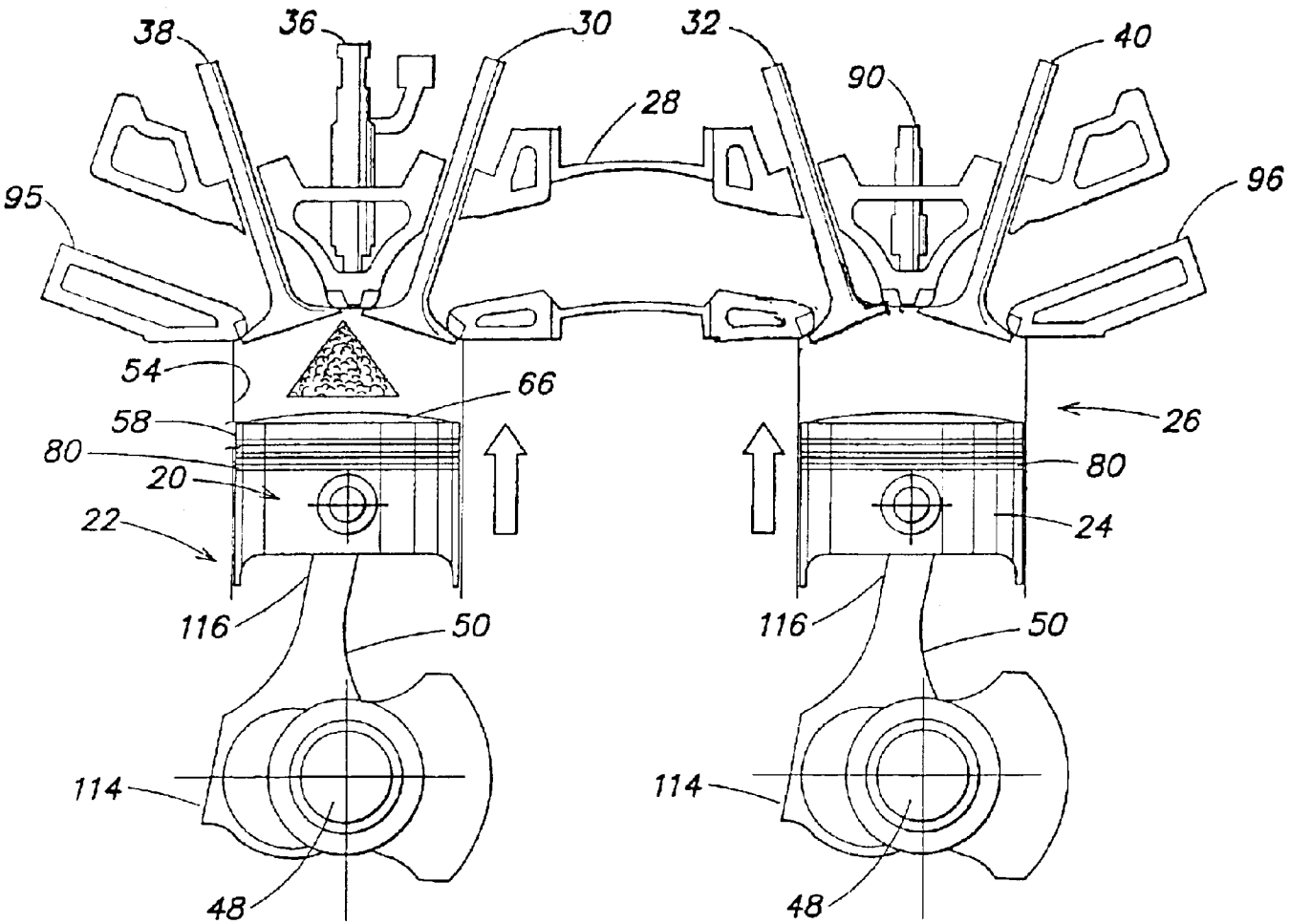
Figure 4I:
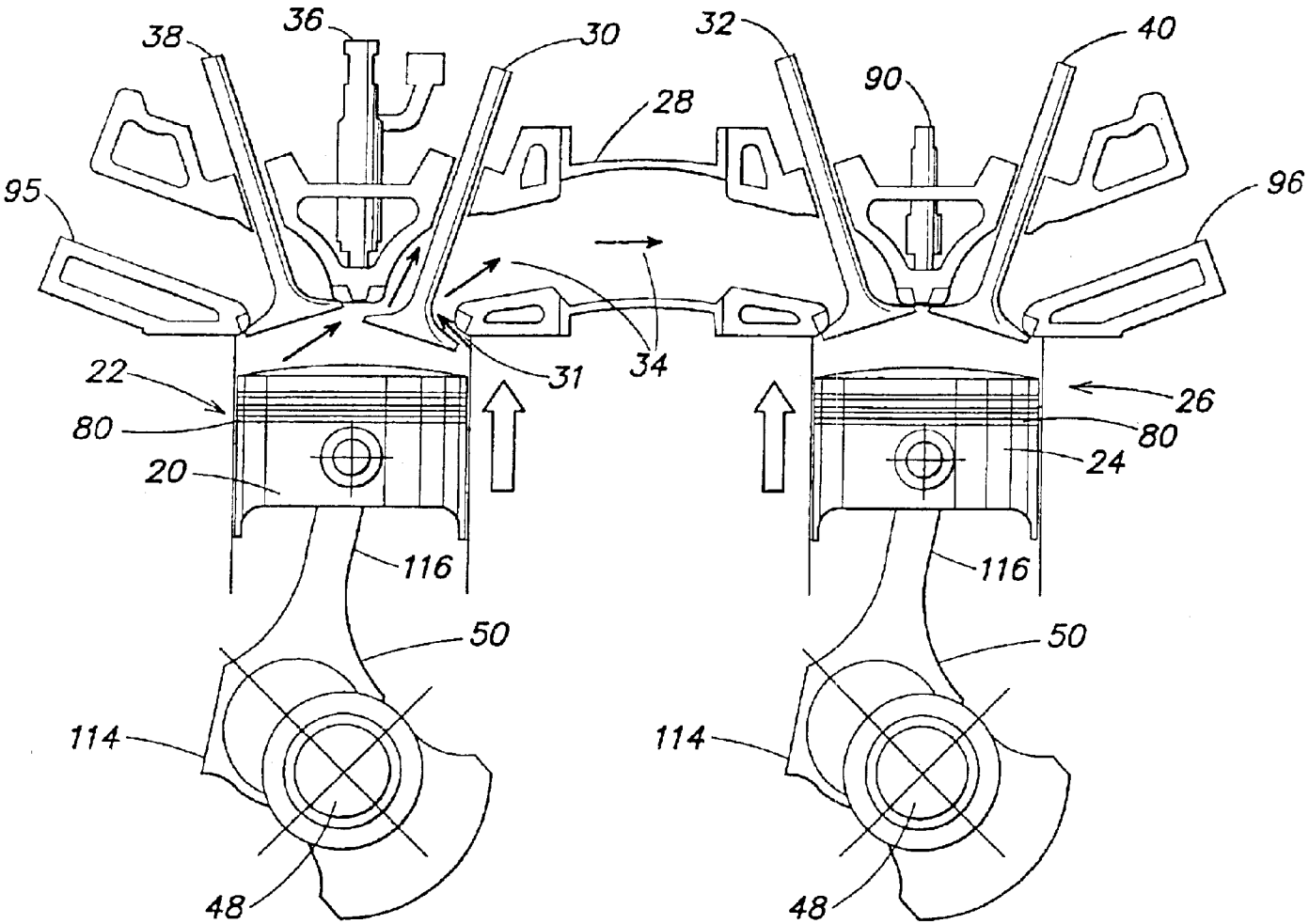
Figure 4J:
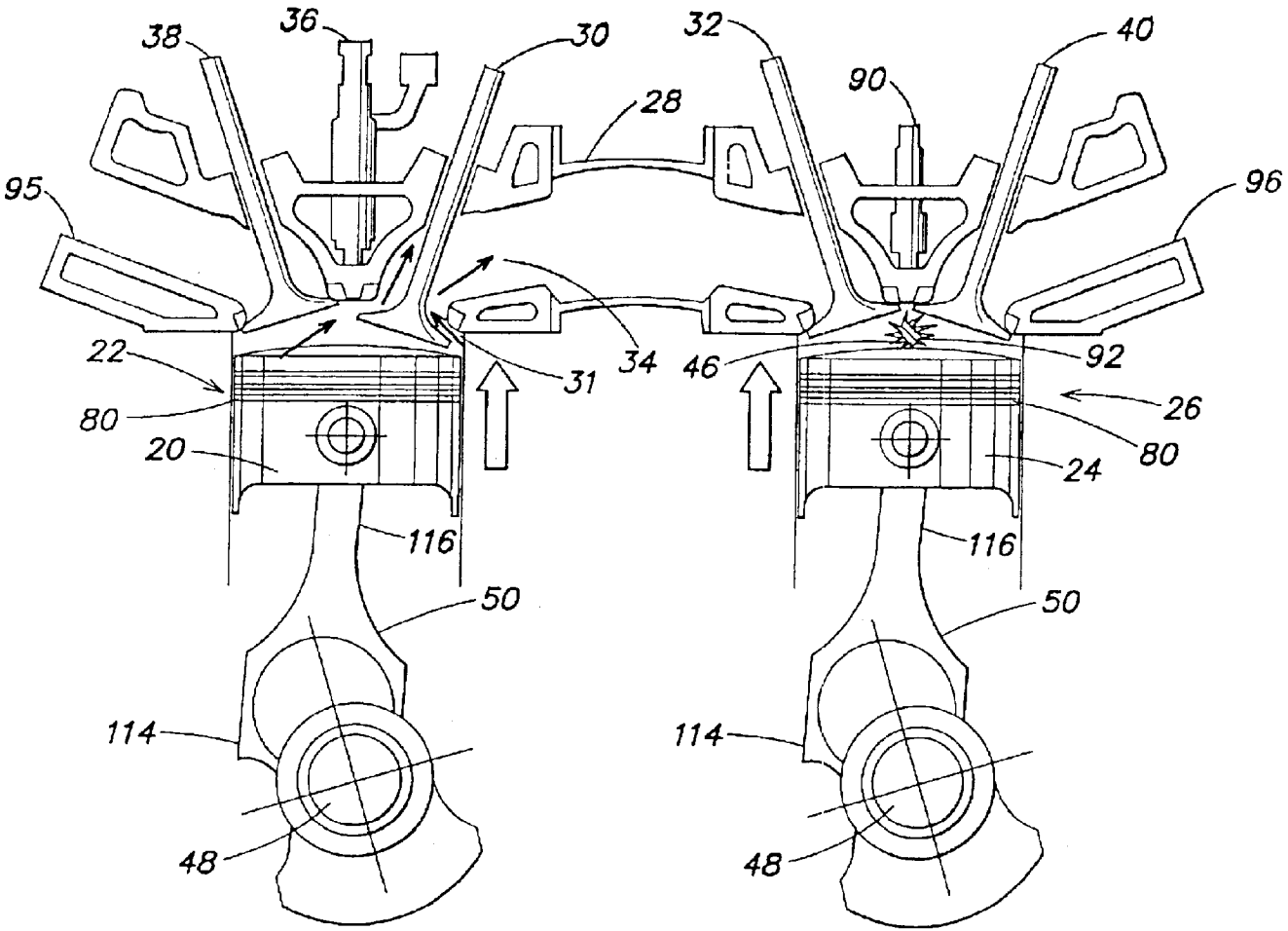
Figure 5A:
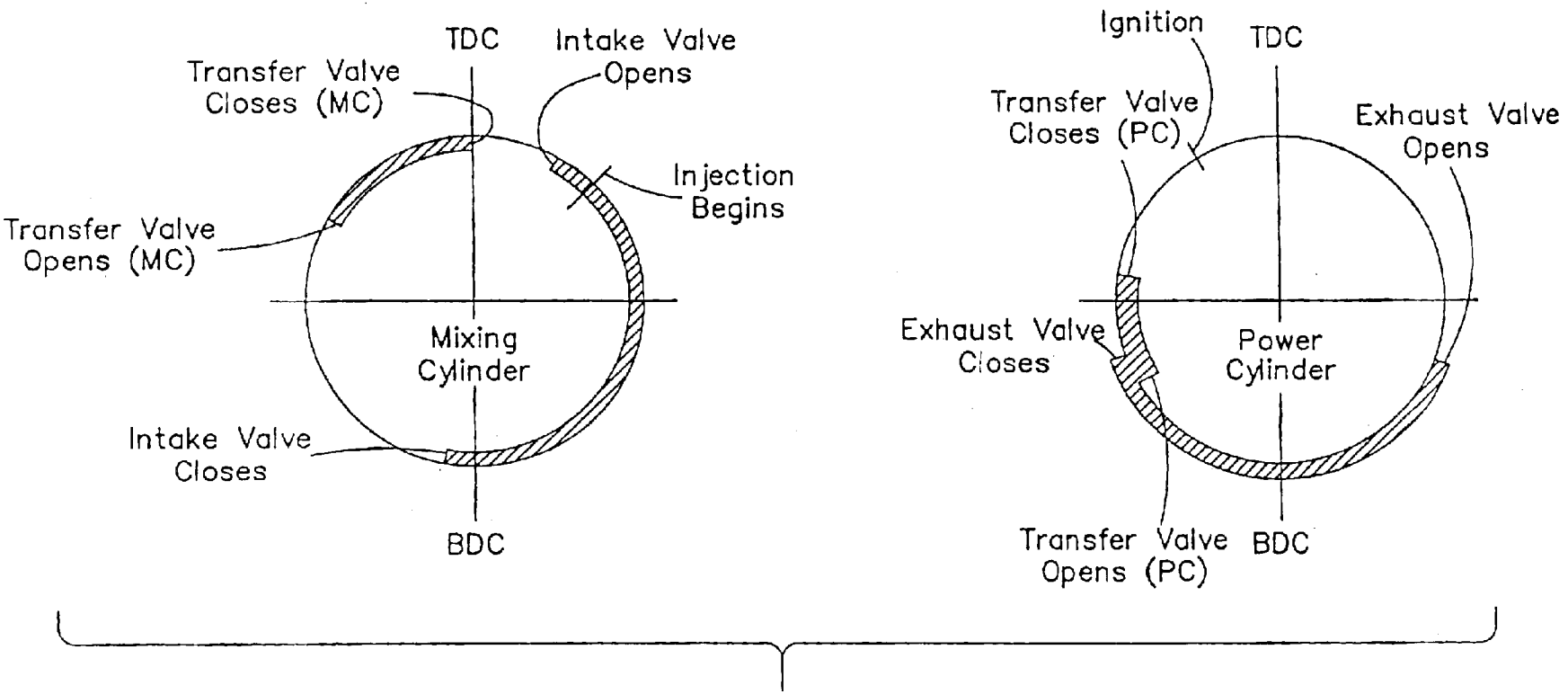
FIGS. 5*a*–5*d* show an engine cycle diagram for embodiments of the invention with a mixing cylinder piston moving in various constant phase relationships with a power cylinder piston, where the power cylinder operates in a two-stroke mode.
Figure 5B:
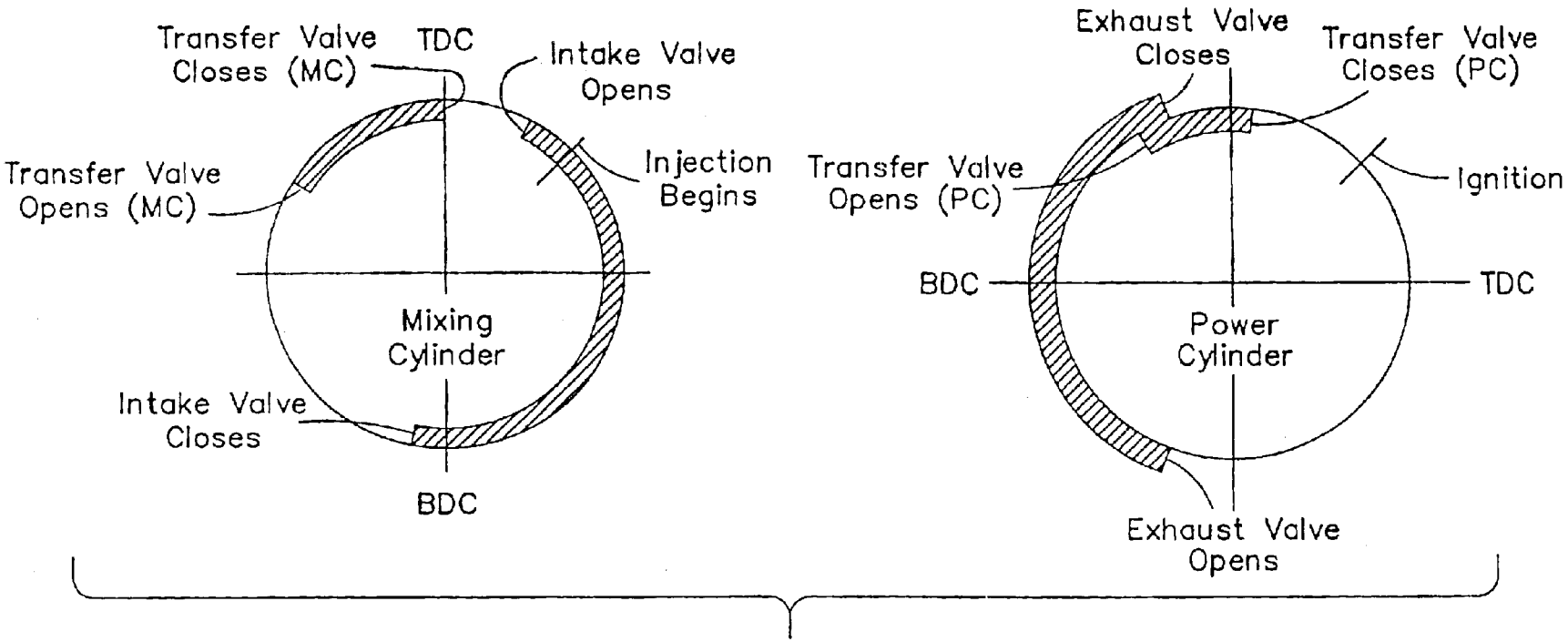
Figure 5C:
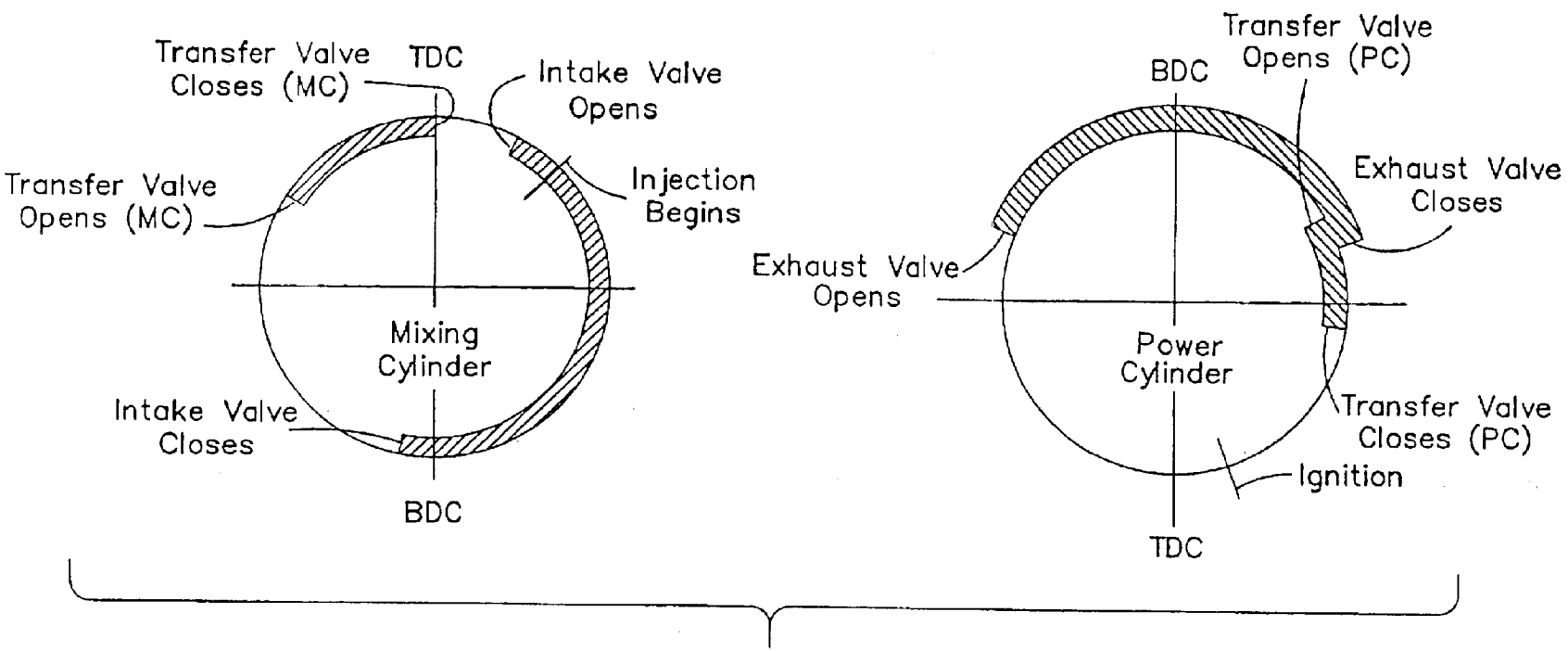
Figure 5D:
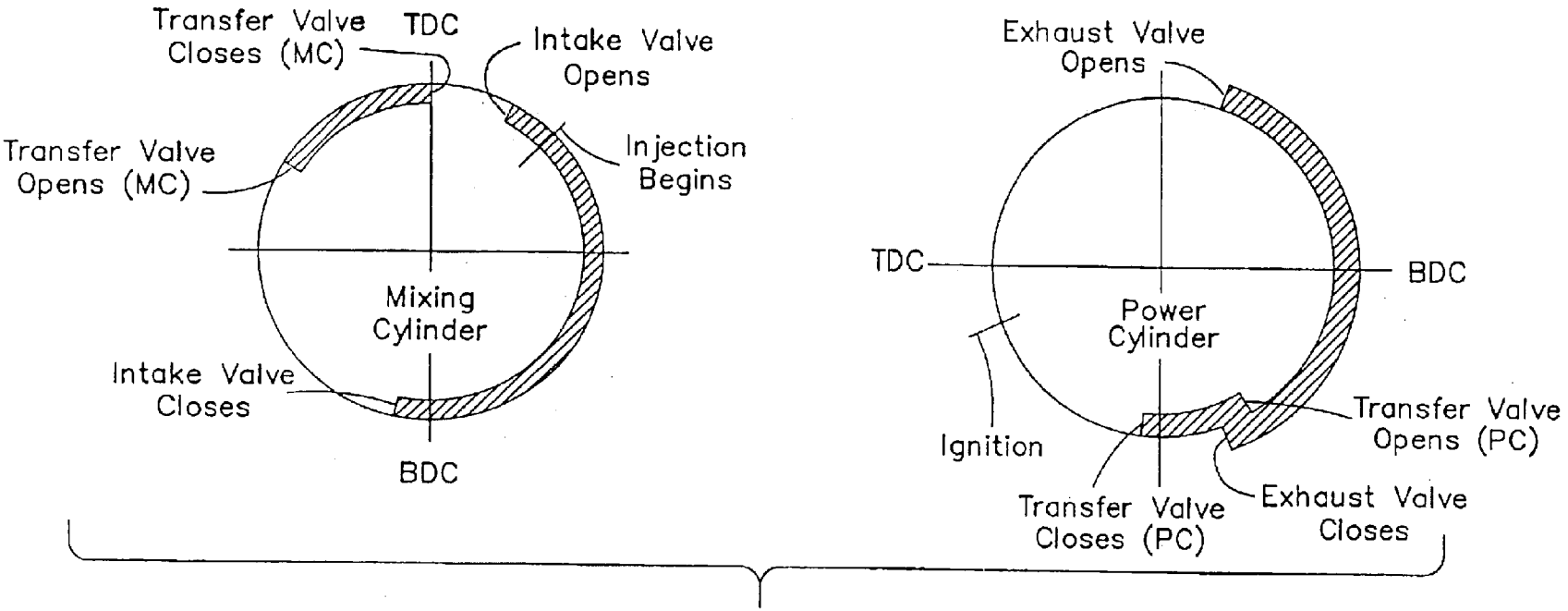
Figure 8:
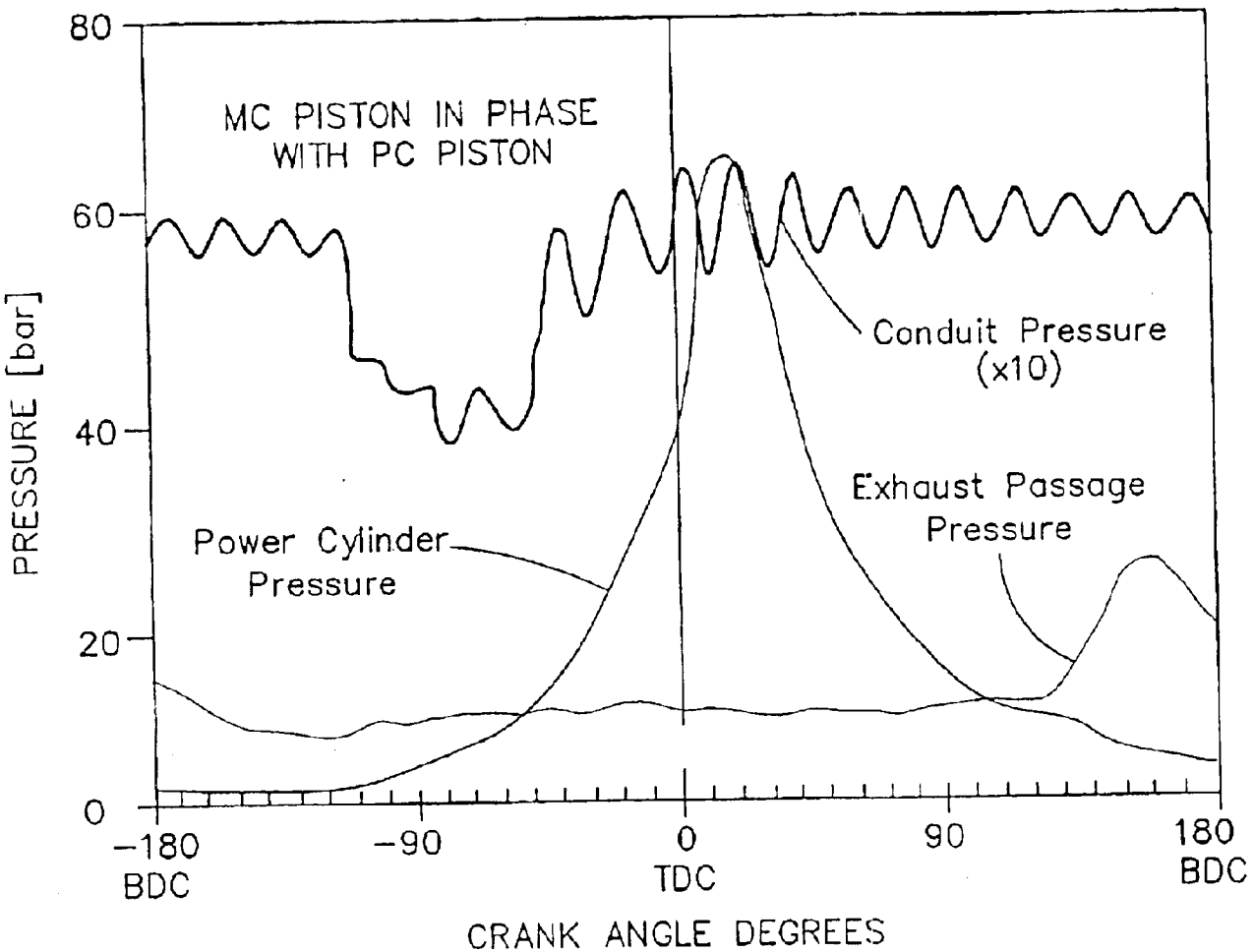
FIG. 8 is a pressure plot for a power cylinder and a conduit of an engine with a mixing cylinder piston moving in phase with a power cylinder piston where the power cylinder operates in a two-stroke mode.

The embodiment represented by FIG. 4*f* shows an air and fuel mixture 34 being delivered from the conduit 28 to the power cylinder when a second transfer valve 32 opens at the opposite end of the conduit 28. This begins anywhere between 20 degrees before top dead center (in the power cylinder) to 20 degrees after top dead center in different embodiments. Intake continues until the transfer valve 32 closes anywhere between 15 degrees after top dead center until bottom dead center. FIG. 3*a* depicts the transfer valve 32 opening at 5 degrees before top dead center and closing at 15 degrees before bottom dead center, although other valve opening and closing times may be suitable for other embodiments. Some factors that may be considered in determining opening and closing times for an engine configuration or a particular engine operating point when variable timing is incorporated include engine speed, required engine power, engine temperature, and conduit pressure at that particular engine operating point to name a few. In embodiments with the power cylinder operating in a four-stroke mode, the air and fuel mixture is delivered from the conduit 28 to the power cylinder 26 as the piston 24 in the power cylinder is generally on its downward stroke. However, in embodiments having a power cylinder that operates in a two-stroke mode, the air and fuel mixture is delivered to the power cylinder 26 as the piston 24 in the power cylinder is on its upward stroke, thus allowing the transfer of the air and fuel mixture to occur within the elevated operating pressure range. This is represented in the FIG. 8 plot of pressure in the conduit 28 and power cylinder 26 versus crank position for an embodiment with a power cylinder operating in a two-stroke mode. In most embodiments, the opening and closing of the second transfer valve 32 is generally timed to prevent flow from occurring in a reverse direction, that is, from the power cylinder to the conduit. However, such flow may occur under some scenarios, such as during engine starting. It is noted that the conduit pressure is shown scaled 10× in FIG. 8. The accumulating aspect of the conduit 28 may allow the air and fuel mixture 34 to be delivered to the power cylinder 26 at a time desired for the particular engine operating conditions. Additionally, the accumulating aspect of the conduit 28 may also allow control of the pressure level at which the air and fuel mixture 34 is delivered to the power cylinder. Control over these variables can greatly assist in tuning the engine to provide improved emission characteristics. Additional flexibility may be afforded by the accumulating asset of the conduit in embodiments where the power cylinder operates in a four-cycle mode. In such embodiments, the conduit is supplied with an air and fuel mixture from the mixing cylinder once during each crank shaft rotation while each of the power cylinders only receive an air and fuel mixture from an accumulator once during every two crank shaft revolutions.

Some embodiments of the conduit 28 may include a fuel delivery device 36 adapted to inject a small portion of atomized or otherwise gaseous fuel into the air and fuel mixture 34 as it enters the power cylinder 26. Such a portion of fuel is intentionally designed to created a fuel rich portion of an otherwise homogenized air and fuel mixture 34. This fuel rich portion is adapted to reside near an ignition device in the power cylinder to aid in initiating combustion. It may also be used in conjunction with an air and fuel mixture 34 that is otherwise lean of fuel. This strategy can be used to lower emissions of NOx and/or hydrocarbons under some circumstances.

The power cylinder piston 24 may continue on its upward stroke to further compress the air and fuel mixture within the power cylinder after the air and fuel mixture 34 has been delivered and the transfer valve closed, as is depicted in FIG. 3*a* and FIGS. 4*h*–4*j*. However, the timing of the delivery of the air and fuel mixture 34 to the power cylinder 26 may differ in other embodiments, as the invention is not limited in this respect. In some embodiments, the second transfer valve 32 between the conduit 28 and the power cylinder 26 can even vary according to particular engine operating parameters, such as engine speed, engine power, and emission characteristics to name a few.

Combustion

After the air and fuel mixture 34 is delivered to the power cylinder and the second transfer valve 32 closes, the air and fuel mixture is ignited to begin the 4*j* combustion process. In the four stroke embodiments (as shown in FIGS. 3*a* and 4*e*), this occurs when the power cylinder piston 24 is between 30 and 10 degrees before top dead center. A spark plug 90 protruding through the firedeck 64 of the cylinder head 68 is typically used to initiate combustion, although other suitable devices may be used as well. Ignition of the air and fuel mixture 34 starts adjacent the protruding end of the spark plug 90 where it forms a flame kernel 92 as shown in FIG. 4*a*. As the piston nears top dead center, the kernel 92 rapidly spreads until a flame front 94 that extends to the cylinder walls 54 is created. This flame front 94 progresses through the cylinder, combusting the air and fuel mixture 34 as it moves through the power cylinder 26, pushing the piston 24 on its downward stroke.

As the air and fuel mixture 34 is burned, the temperature and pressure within the power cylinder 26 rapidly increase. The rapidly increased pressure drives the power cylinder piston 26 downward, thereby creating useful mechanical work. This work is transferred from the piston 26 to the crankshaft 48 of the engine via a connecting rod 50 as shown in FIG. 4*a*.

As was previously discussed, the air and fuel mixture 34 enters the power cylinder free of liquid fuel and in a homogenized state (except for embodiments that intentionally have a fuel rich area for ignition). Having such a homogenized, liquid free air and fuel mixture allows the flame front 94 to burn the air and fuel mixture 34 substantially completely as it propagates through the cylinder 26, which can improve the hydrocarbon emission characteristics of the engine. Furthermore, an air and fuel mixture free of liquid fuel will make it difficult for any liquid fuel to become trapped in the crevices between the piston and the cylinder wall, or on the cylinder walls where it can be difficult to combust. Uncombusted fuel in such crevices and on the cylinder walls can also cause hydrocarbon emissions.

Furthermore, an homogenized air and fuel mixture helps prevent knocking from occurring in the power cylinder. As combustion progresses through the cylinder, the pressure and temperature increase dramatically. The pressure and temperature may become great enough to cause any unburned fuel rich areas of the air and fuel mixture 34 to auto-ignite at secondary locations in cylinder. If this occurs, an additional flame front may be created that can disrupt the combustion process. The additional flame front can cause incomplete combustion of the air and fuel mixture 34, leading to hydrocarbon emission problems. Also, the additional flame front may also cause shockwaves that can propagate through the engine causing damage thereto.

While knocking can be caused by a non-homogenized mixture, it can also be caused by hot spots within a cylinder. Deposits left on the power cylinder surfaces by incomplete combustion of previous cycles may remain hot after combustion has occurred. If they remain hot for long enough, they can ignite the air and fuel mixture delivered to a power cylinder during a subsequent engine cycle, thus causing secondary ignition and the aforementioned knocking phenomenon. By providing a homogenized mixture to the power cylinder, embodiments of the present invention promote complete combustion of the air and fuel mixture. This also prevents the formation of deposits on the surfaces of the power cylinder, thereby reducing the possibility for the knocking phenomenon to occur.

In conventional engines, unwanted auto-ignition can also occur during the compression stroke of an engine cycle. This cannot occur in embodiments of the present invention where substantially all of the compression takes place in the mixing cylinder, and the power cylinder operates in a two-stroke (power, exhaust) mode. In embodiments where the power cylinder operates in a four-stroke mode (intake, compression, power, exhaust) auto-ignition is still avoided because of the highly homogenized mixture that is delivered to the power cylinder and made possible because of the presence of the mixing cylinder 22 and the conduit 28. The mixing cylinder does not sustain combustion and therefore should not contain any deposits where auto-ignition can begin. Furthermore, the mixing cylinder 22 is not subjected to high combustion temperatures and can therefore remain at a temperature that will help prevent auto-ignition as was previously discussed.

In some embodiments additional features may be added to improve the fuel efficiency and/or mean effective pressure of the present invention. In one embodiment having a power cylinder operating in a two-cycle mode, the cross-sectional area of the mixing cylinder is larger than the cross-sectional area of the power cylinder. Then, when the second transfer valve 32 between the conduit and the power cylinder opens into Cylinder P (as the piston in the mixing cylinder moves toward TDC) and during the power stroke of the power cylinder (as the piston in the power cylinder moves down from TDC), the pressure continues to go up during the ignition phase of the power cylinder.

In another embodiment, a piston head with two different cross-sectional areas is used. Such a piston has a cascade of two cylindrical sections in the power cylinder. The top of the piston is narrower than the main part of the piston in the power cylinder. At top dead center of the power cylinder piston, the small piston head fits inside the cavity made in power cylinder. When the second transfer valve of the power cylinder opens, the pressure continue to build, although the power cylinder piston begins to move down after reaching top dead center, because the total volume continues to decrease until the smaller section of the piston leaves the cavity in the cylinder head (i.e., the volume expansion of on top of the power cylinder piston is smaller). The clearance between the narrow section of the piston and the cavity created in the cylinder head is so small that gas cannot leak into the larger volume on top of the larger section of the power cylinder during the ignition and the early stages of the flame propagation phase.

Exhaust

The combustion process may terminate anywhere between 45 degrees before bottom dead center to 20 degrees after top dead center in embodiments having a power cylinder operating in a four-stroke mode. At this point, an exhaust valve 40 opens fluid communication with an exhaust port 96 disposed outside of the power cylinder 26. This allows the still pressurized combustion products within the cylinder to escape through the exhaust port. As the power cylinder piston begins moving upward toward top dead center, it helps expel the remaining combustion products from the power cylinder 26.

In some embodiments having a two-stroke mode in the power cylinder, substantially complete removal of the exhaust products is possible in the power cylinder 26 as the cylinder can be designed with substantially no or minimal clearance volume if desired in such embodiments. The fact that compression of the air and fuel mixture 34 occurs primarily within the mixing cylinder 22 allows there to be minimum clearance volume within the power cylinder 26. In embodiments having two or four-stroke modes in the power cylinder, some clearance volume may exist to prevent the air and fuel from being compressed to extreme pressures, which can cause knocking in some scenarios as was previously discussed.

In other embodiments of the invention, retaining some of the combustion products within the power cylinder 26 for admixing with the air and fuel mixture 34 of a subsequent cycle may be desired. Such strategies to re-circulate exhaust gases can reduce NOx emissions of an engine. A portion of the combustion products may be retained in the power cylinder 26 either by including a clearance volume in the power cylinder 26, or by timing the opening and closing of the second transfer valve 32 and exhaust valve 40 of the power cylinder 26 accordingly.

In some embodiments of the engine, the end of the exhaust process may overlap with the beginning of the intake process. For instance, the embodiment of FIG. 3*a* has the transfer valve 32 into the power cylinder 26 open for approximately 10 degrees while the exhaust valve 40 is open. This allows the incoming air and fuel mixture 34 to help purge the combustion products from the power cylinder 26. Some embodiments also retain a portion of approximately 20% of the combustion products for mixing with the incoming air and fuel mixture to help reduce NOx emissions. This also helps insure that the air and fuel mixture 34 is not allowed to escape through the exhaust port 96 and contribute to hydrocarbon emissions.

The power cylinder 26 comprises many conventional features that are typically used within a cylinder to support combustion therein. For instance, piston ring technology, cylinder surfacing technologies, cooling technologies, and other suitable features maybe incorporated into the power cylinder design.

Alternate Cycle Embodiments

Figure 6A:
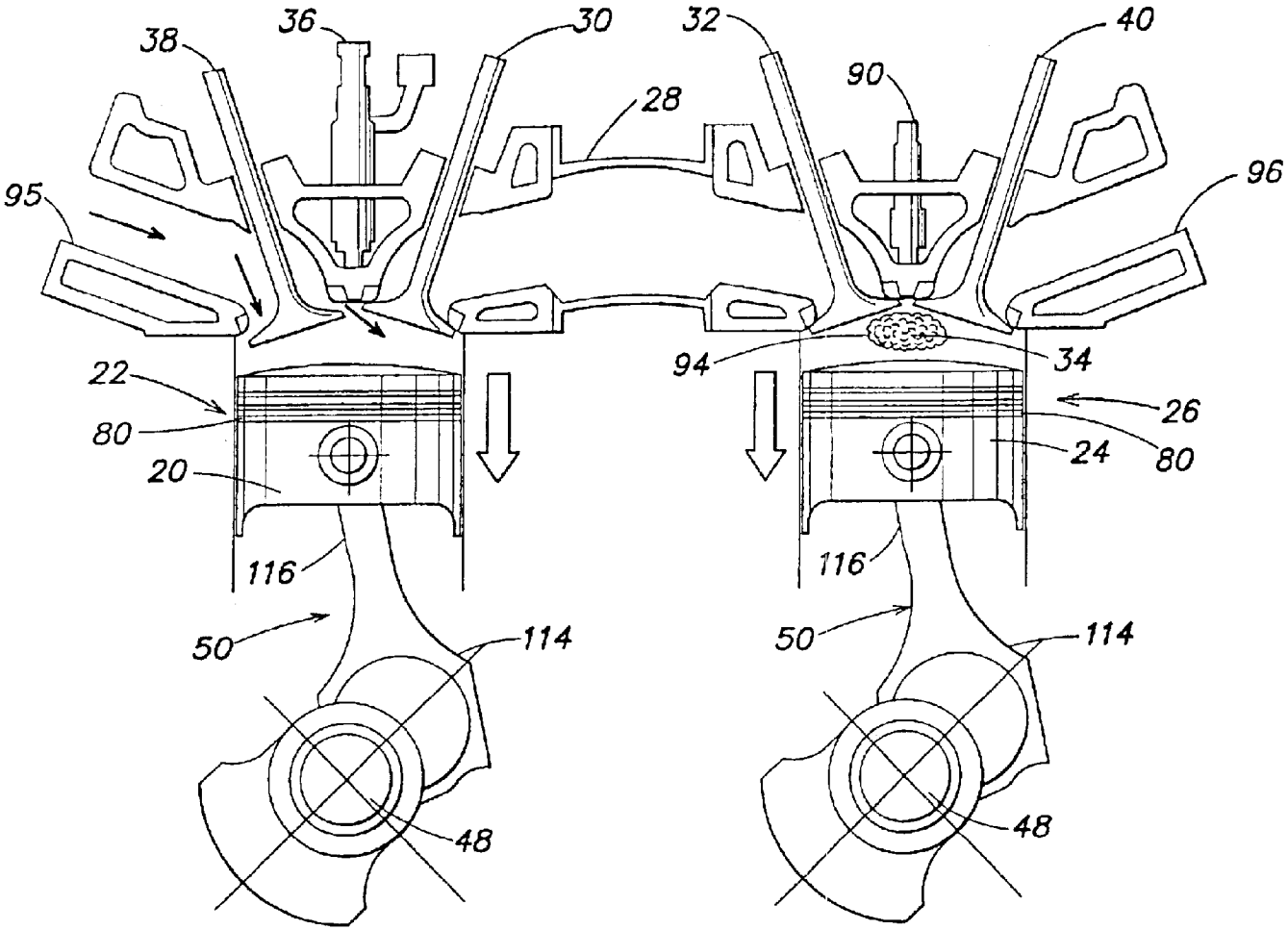
FIGS. 6*a*–6*e* show an engine cycle diagram for embodiments of the invention with a mixing cylinder piston moving in various constant phase relationships with a power cylinder piston, where the power cylinder operates in a two-stroke mode.
Figure 6B:
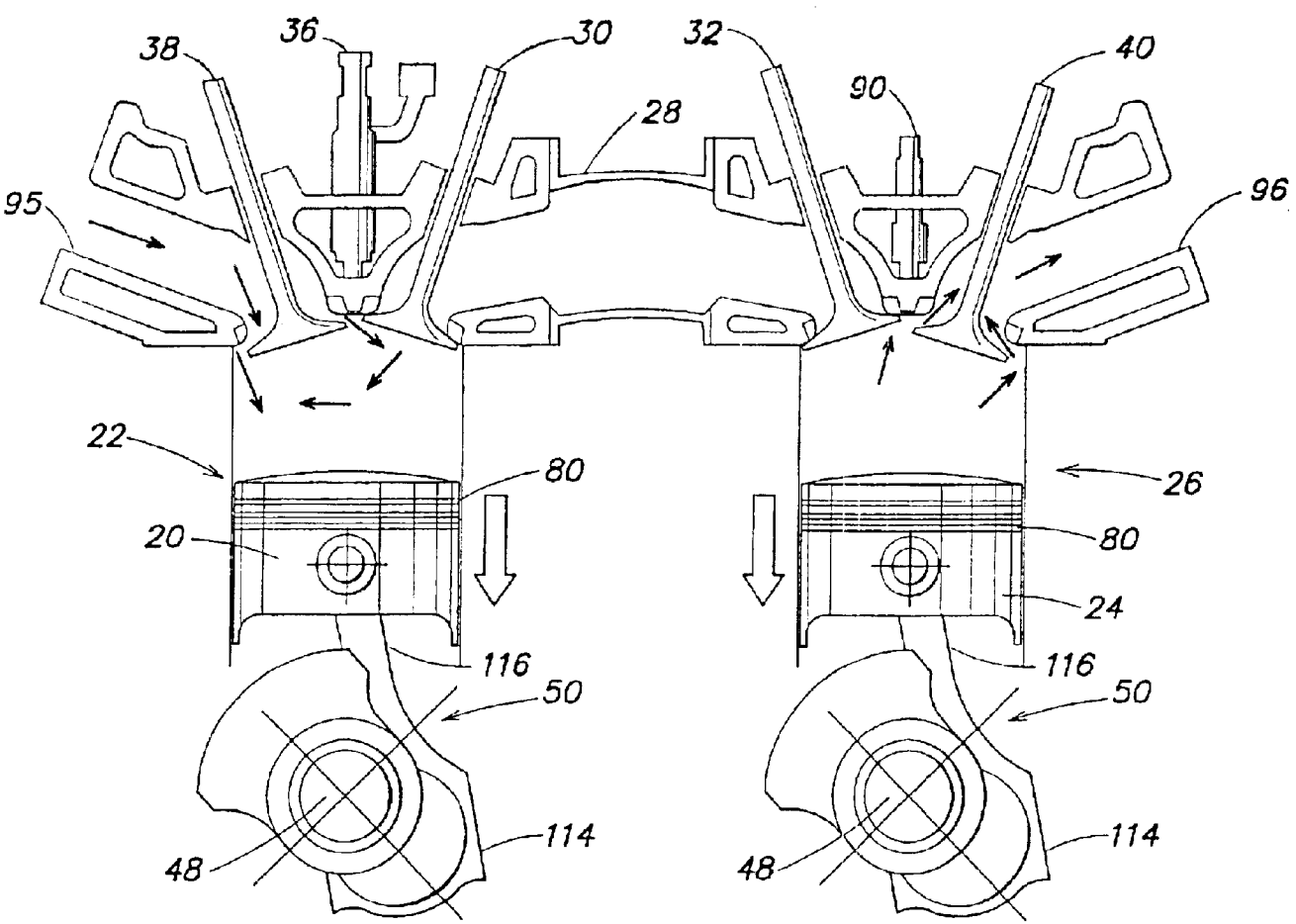
Figure 6C:
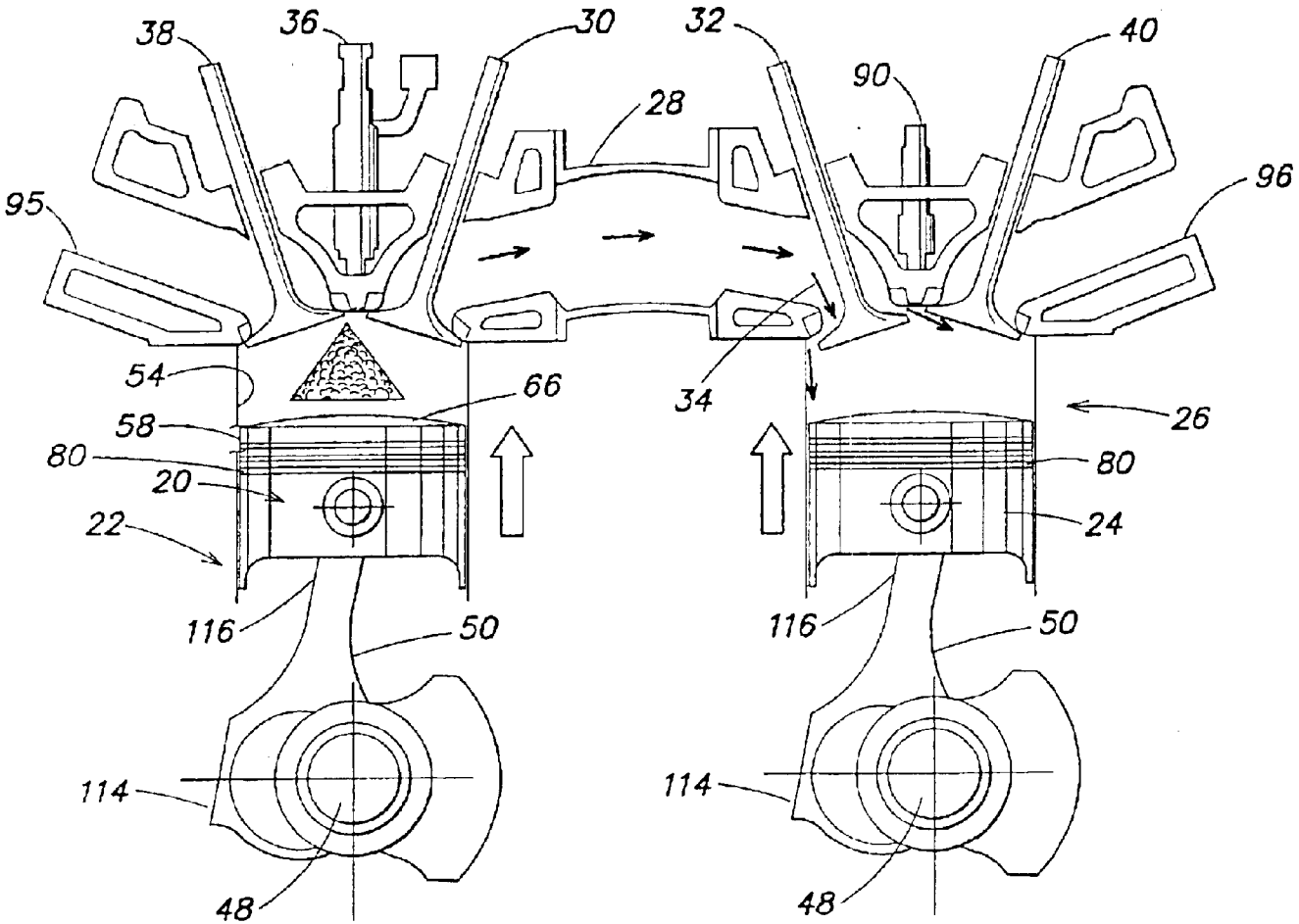
Figure 6D:
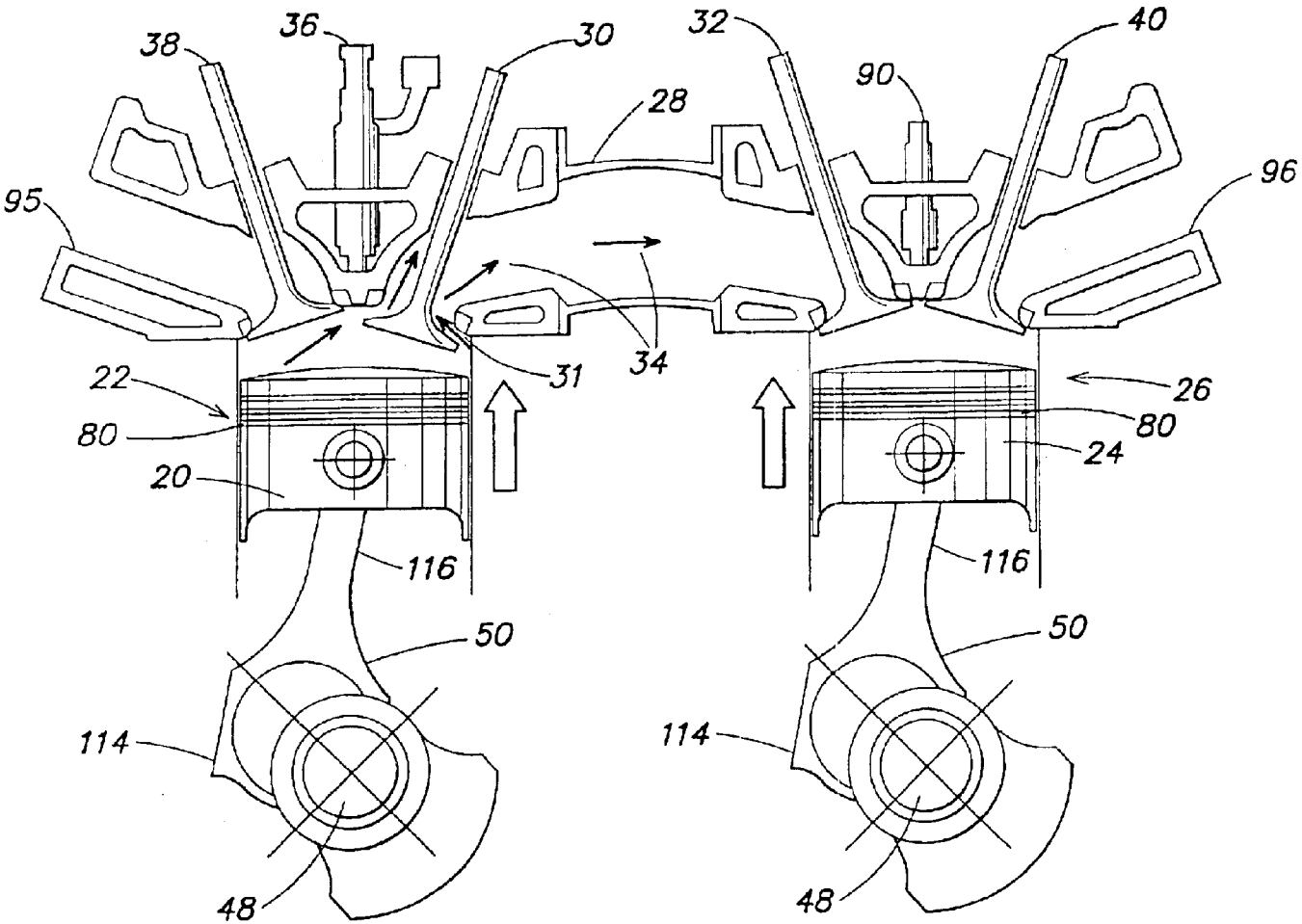
Figure 6E:
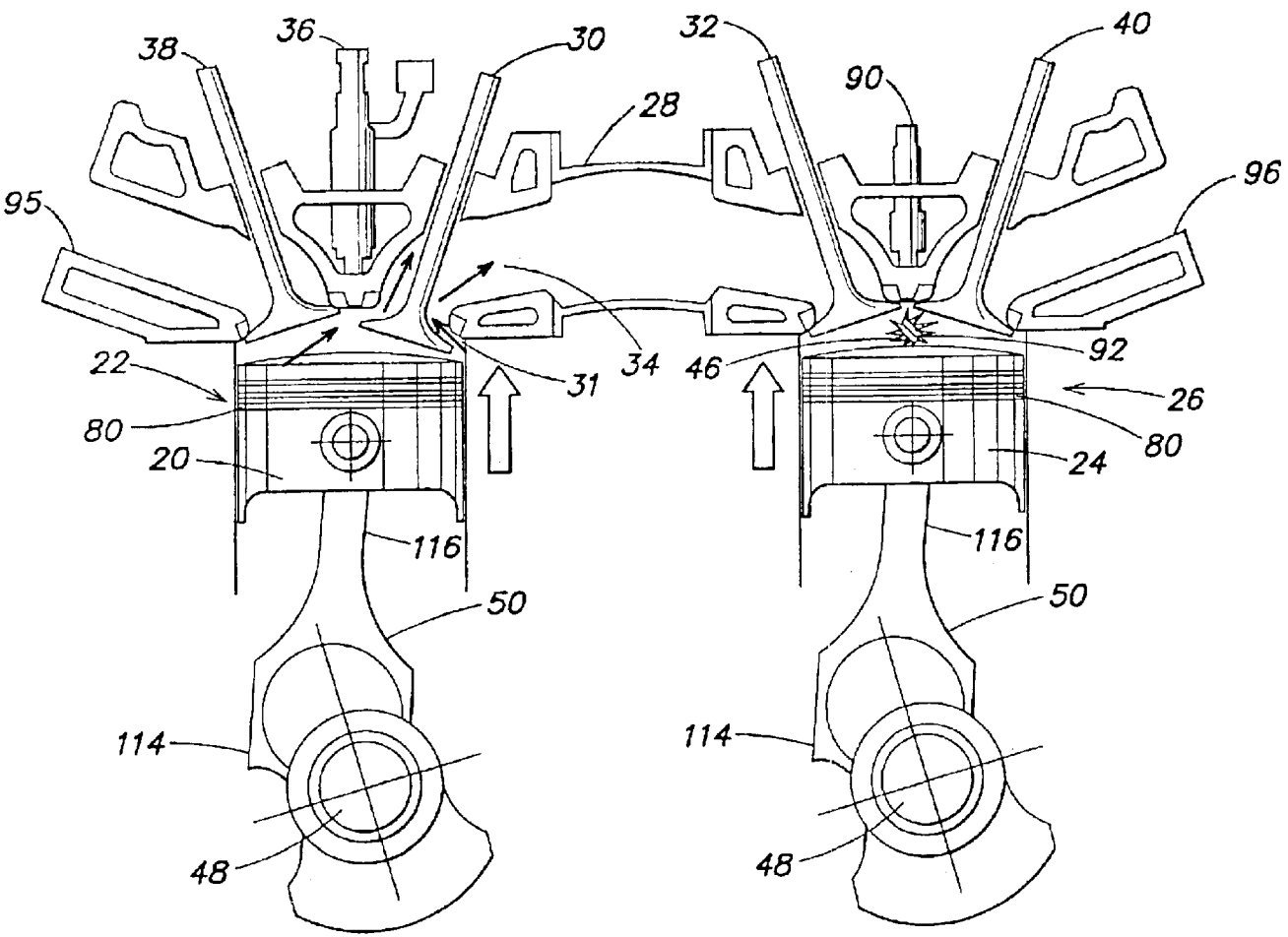
Figure 9A:
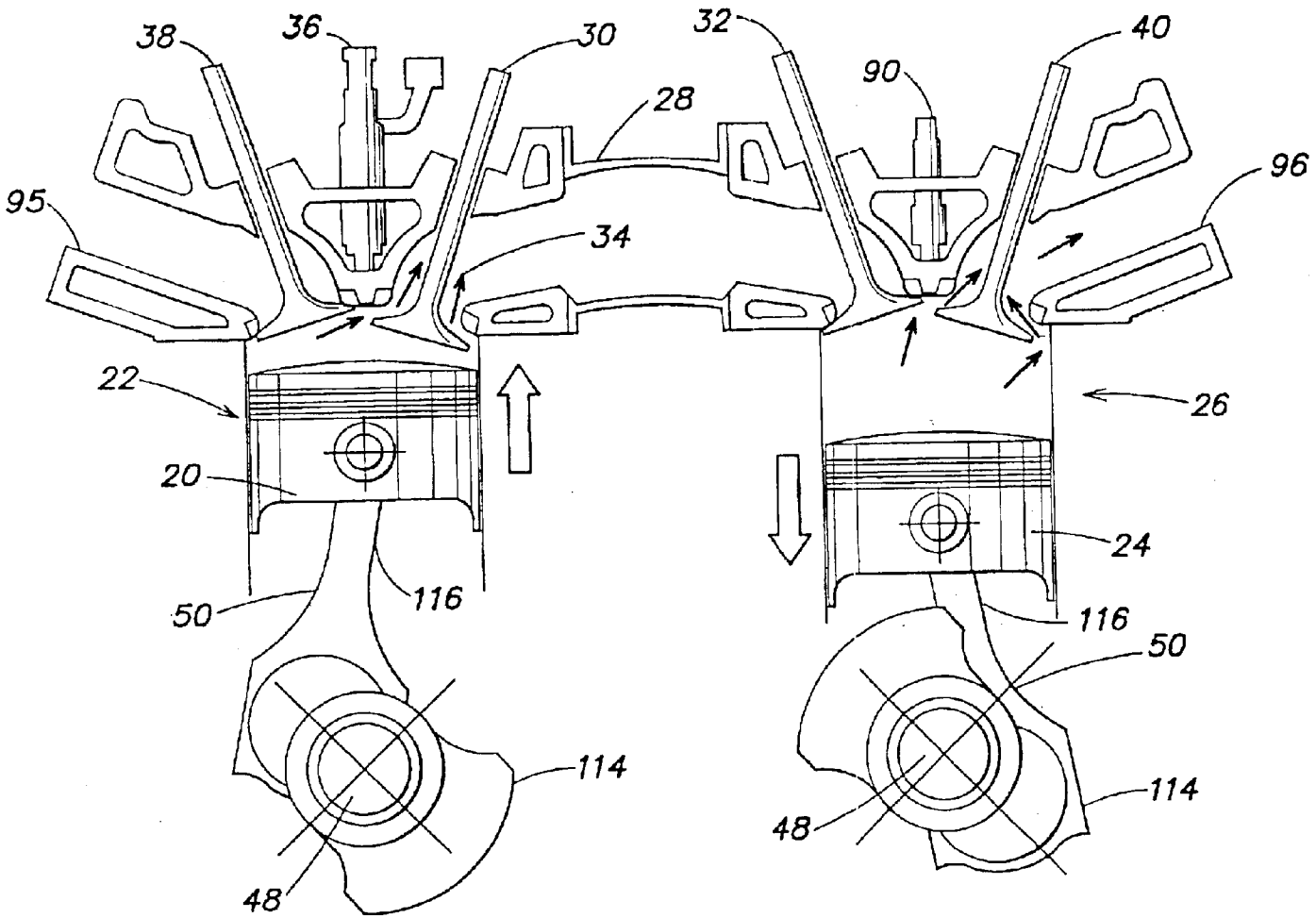
FIGS. 9*a*–9*b* are schematic representations of an engine at various steps of an engine cycle with a mixing cylinder piston moving 180 degrees out of phase with a power cylinder piston where the power cylinder operates in a two-stroke mode.
Figure 9B:
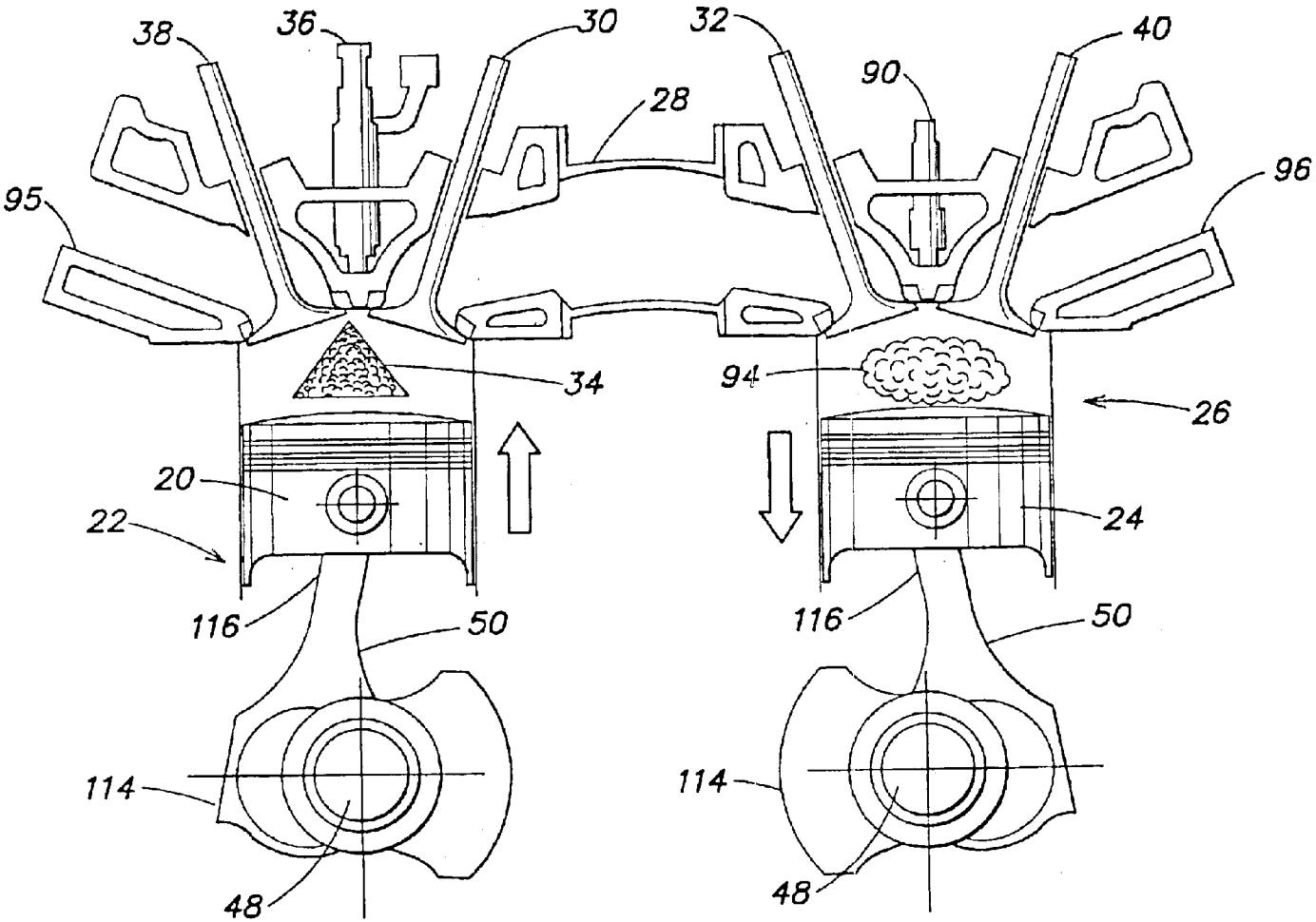
Figure 10:
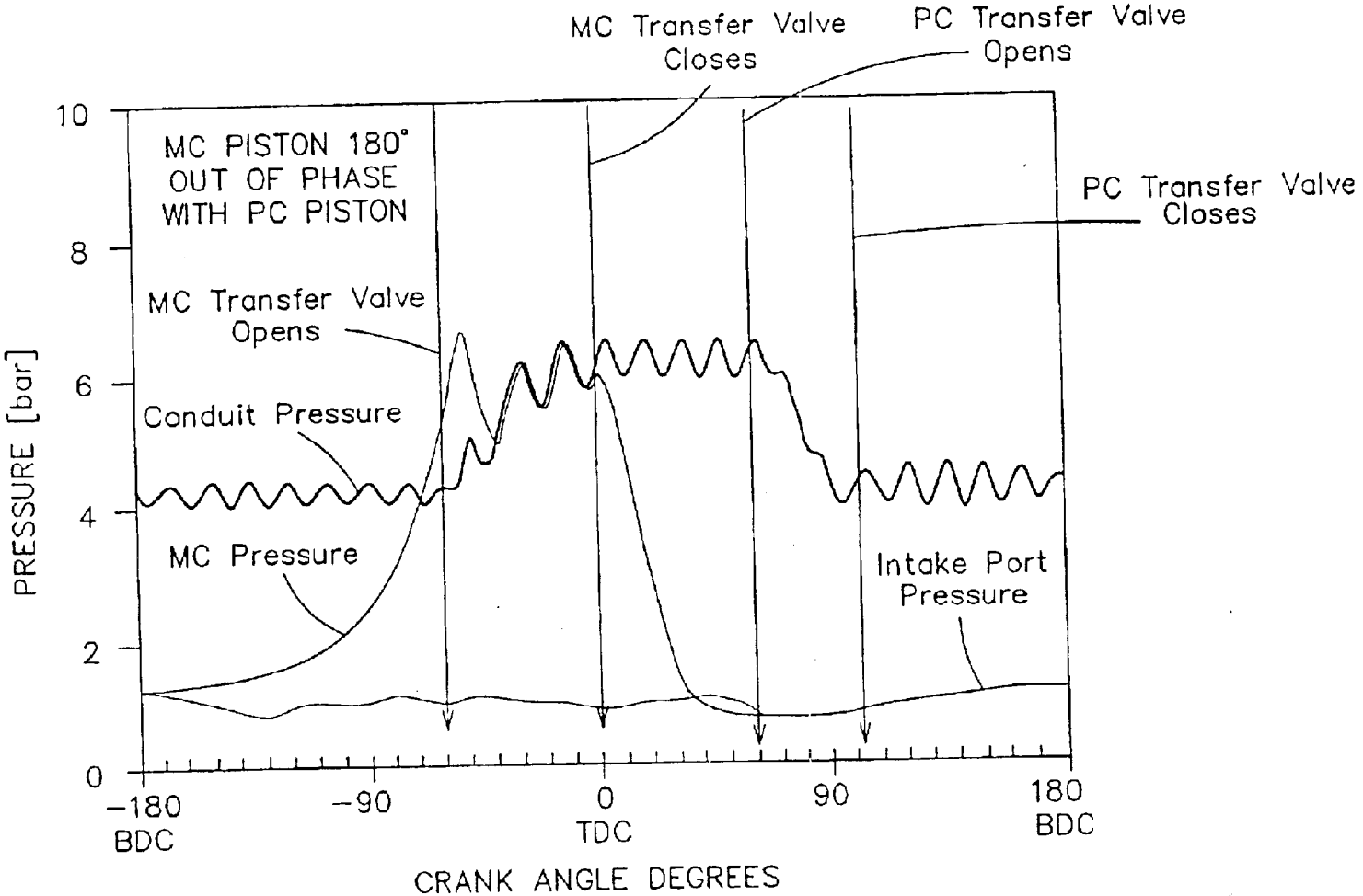
FIG. 10 is a pressure plot for a mixing cylinder and a conduit of an engine with a mixing cylinder piston moving 180 degrees out of phase with a power cylinder piston where the power cylinder operates in a two-stroke mode.
Figure 11:
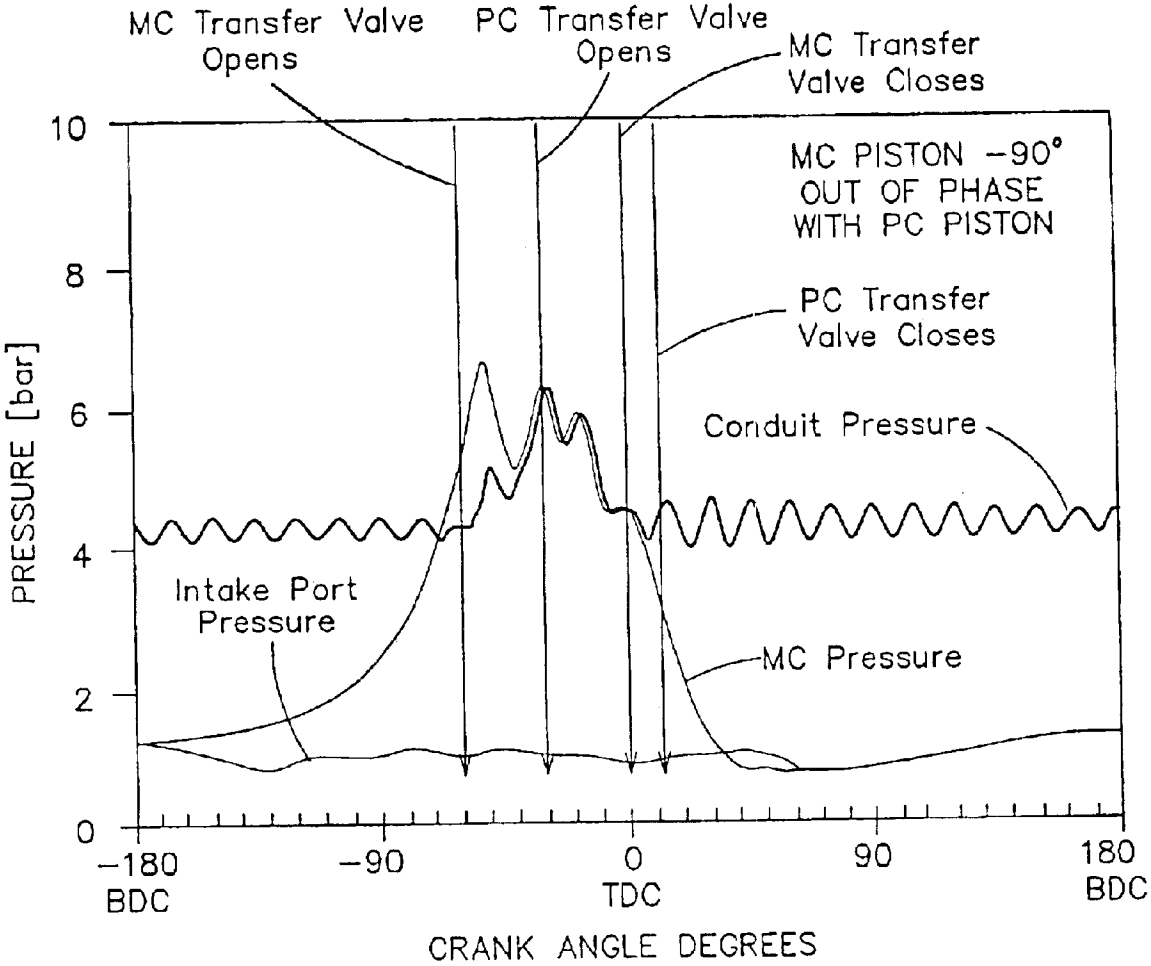
FIG. 11 is a pressure plot for a mixing cylinder and a conduit of an engine with a mixing cylinder piston moving 90 degrees behind a power cylinder piston where the power cylinder operates in a two-stroke mode.
Figure 12:
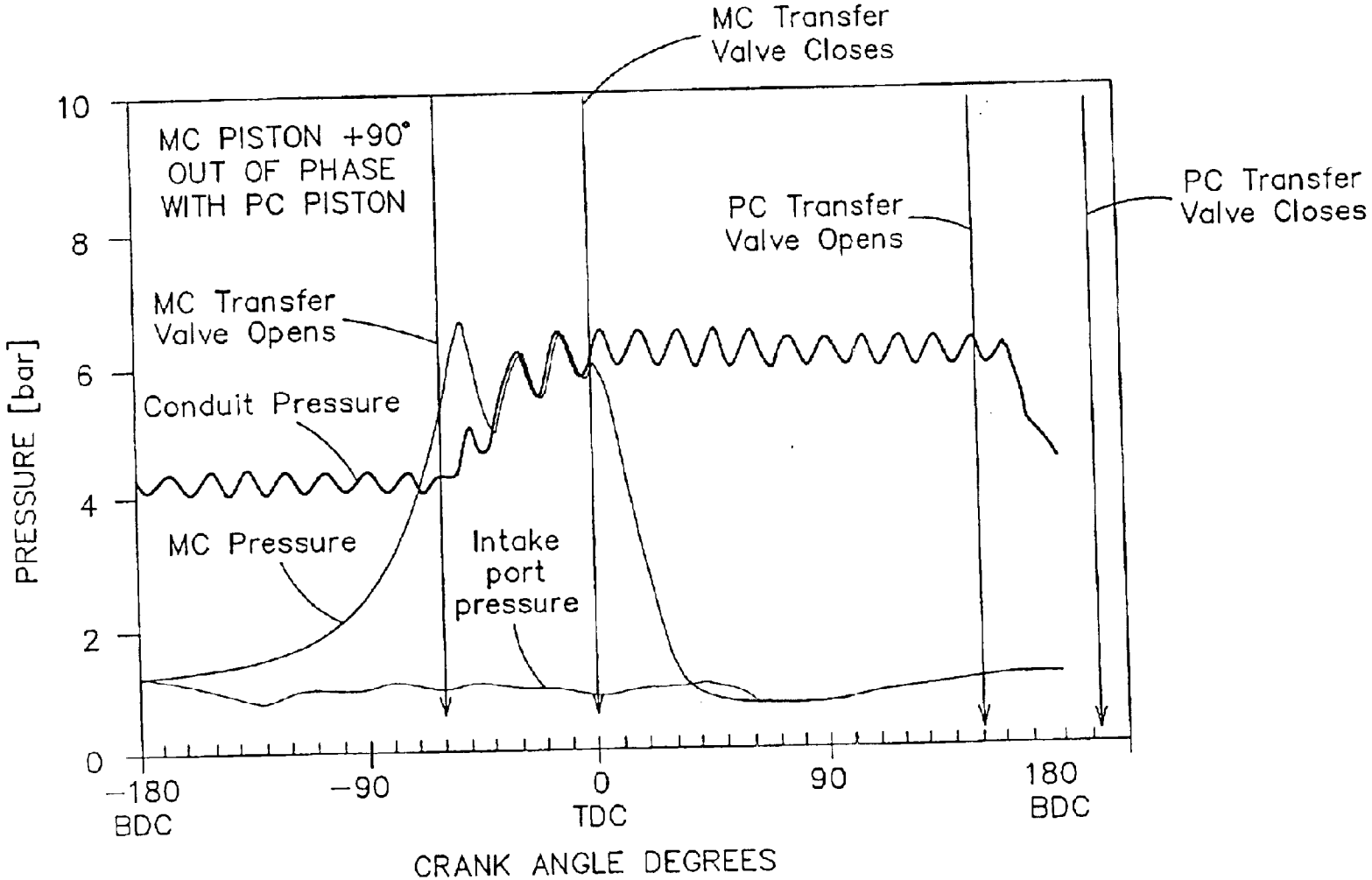
FIG. 12 is a pressure plot for a mixing cylinder and a conduit of an engine with a mixing cylinder piston moving 90 degrees ahead of a power cylinder piston where the power cylinder operates in a two-stroke mode.

An entire engine operation cycle has been described according to two basic embodiments of the invention, namely an embodiment where intake and compression occurs in the mixing cylinder only, and another embodiment where intake and compression occur in both the mixing cylinder and the power cylinder. However, other variations of the engine operation cycle may exist that are within the scope of the invention. For instance, FIGS. 5*a*–5*d* show various cycles for an embodiment having a power cylinder operating in a two-stroke mode. FIGS. 6*a*–6*e* show depictions of the mixing cylinder piston, the power cylinder pistons, and all valves generally corresponding to the cycle represented by FIG. 5*a*. In each of these variations, the motions of the mixing cylinder piston 22, intake valve 38 and mixing cylinder transfer valve 30 are similar. However, the power cylinder piston 24 moves in a different phase relationship with the mixing cylinder piston 20. The power cylinder transfer valve 32 and the exhaust valve 40 are shown to maintain a similar opening and closing relationship to the power cylinder piston 24, although other relationships may also exists, as the invention is not limited in this respect. Similar variations may also exist in embodiments having a power cylinder operating in a four-stroke mode. FIGS. 9*a*–9*b* show two points in an engine cycle embodiment where the piston 20 of the mixing cylinder 22 and the piston 24 of the power cylinder 26 are moving 180 degrees out of phase with one another as is also represented by FIG. 6*c*. In particular, FIG. 9*a* shows the mixing cylinder piston near top dead center as it is transferring an air and fuel mixture 34 to the conduit 28. It also shows the power cylinder piston 24 nearing bottom dead center as the exhaust valve 40 opens, thereby beginning the exhaust phase of the engine cycle. The mixing cylinder piston 20 and the power cylinder piston are shown attached to two different crankshafts 48 for illustrative purposes only in FIGS. 9*a*–9*b*. The pressure of the mixing cylinder 22 and conduit 28 versus piston position for another embodiment of the engine is shown in FIG. 10. In this embodiment, the mixing cylinder piston 20 and the power cylinder piston 24 move 180 degrees out of phase with one another and the power cylinder apertures in a two-stroke mode. This figure shows pressures for a particular embodiment of the invention operating at 3500 revolutions per minute. It is is noted that piston position shows on the horizontal axis is that of the mixing cylinder 22. A similar plot for an embodiment of the invention with a mixing cylinder piston 20 following the power cylinder piston 24 by 90 degrees is shown in FIG. 11 which also corresponds to the cycle of FIG. 5*d*. In this particular embodiment, the transfer valves 30, 32 at either end of the conduit 28 are both open concurrently for approximately 30 degrees crank angle. This serves to slightly lower the elevated operating pressure range average. Yet another mixing cylinder 22 and conduit 28 pressure plot are shown in FIG. 12 for an embodiment of the invention with mixing cylinder piston 20 leading the power cylinder piston 24 by approximately 90 crank angle degrees. This cycle corresponds to that of FIG. 5*b*.

General Engine Construction

Figure 13:
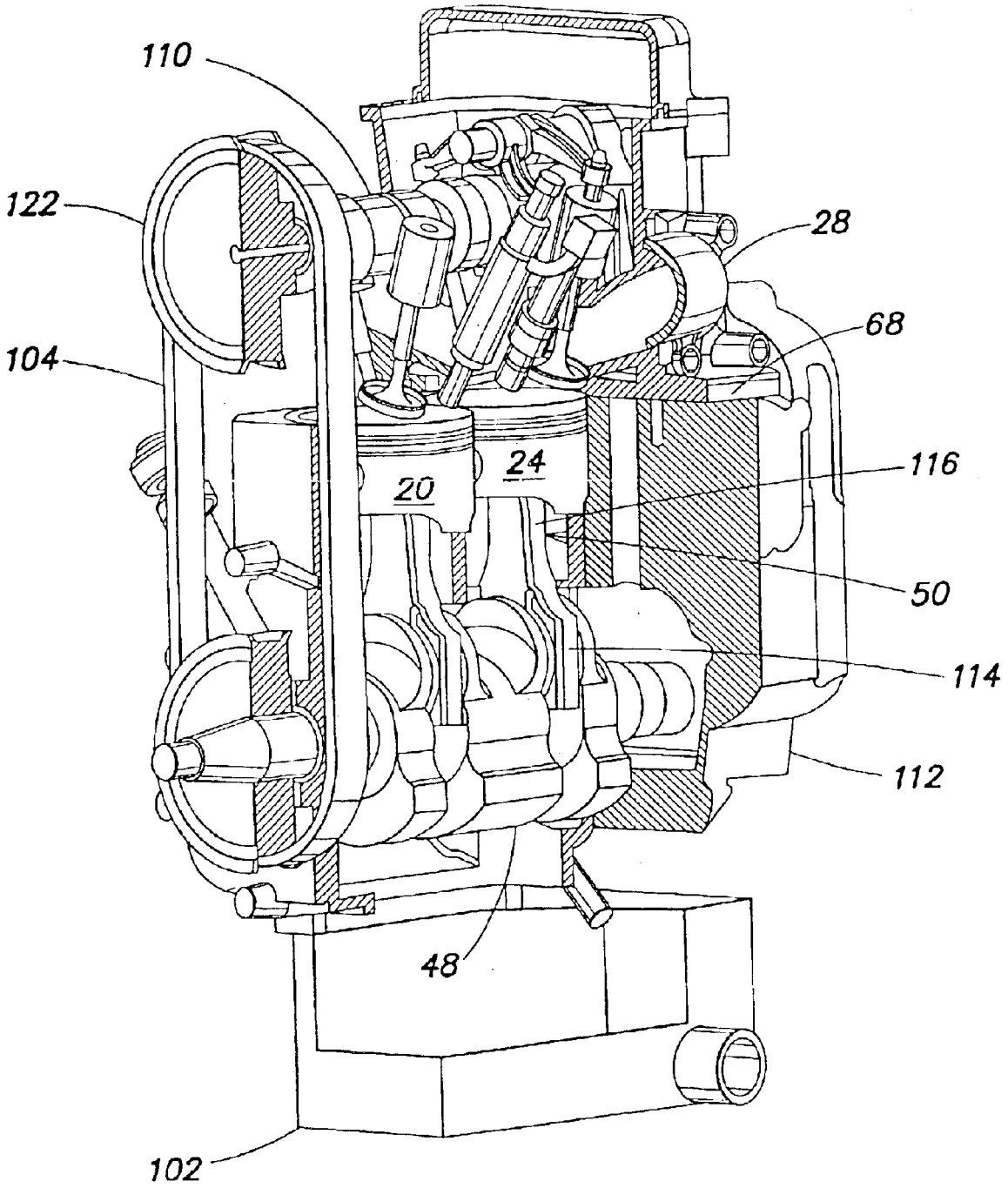
FIG. 13 is a cutaway schematic of an engine with one mixing cylinder in fluid communication with one power cylinder according to one aspect of the invention.
Figure 14:
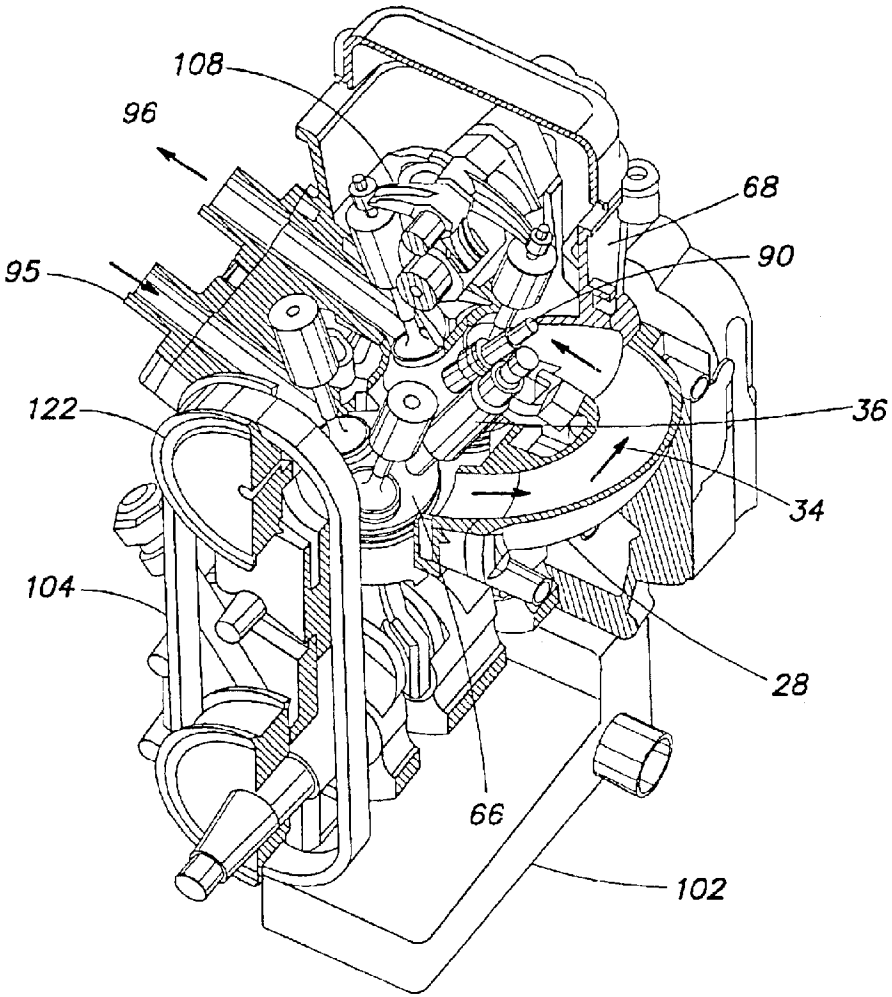
FIG. 14 is another cutaway schematic of the embodiment shown in FIG. 12.

The various engine structures that may be employed to provide the above-described cycles are now discussed. FIGS. 13 and 14 each show cutaway schematic view of an embodiment of the invention. This particular embodiment is an inline, two-cylinder engine configuration where each cylinder has a swept volume of approximately 110 cubic centimeters. However, other configurations such as "V" configurations "W" configuration engines, opposed cylinder engines, "H" engine configurations or even Wankel-type engines could employ features of the present invention to improve their emissions characteristics. Furthermore, any number of mixing cylinders 22 and power cylinders 26 may be employed by a given engine. The cylinders may have swept volumes either greater or smaller than the 110 cc swept volume depicted in FIGS. 13 and 14. The specific configurations of many of the engine components shown in FIGS. 13 and 14, such as the oil pan 102, the timing belt 104, the exhaust and intake port 95 and 96, respectively, the rocker arms 108, and the camshaft 110 to name a few are shown as a representative example and are not intended to be required in any embodiment of the invention. While the engine operating cycle has been described with respect to a spark ignition engine, and FIGS. 13 and 14 depict a spark ignition engine, auto ignition engines (e.g. diesel) may also benefit from many of the features of the present invention.

Embodiments of the invention include a crankshaft 48 disposed within a cylinder block 112 with the crankshaft 48 adapted to rotate about a circular orbit therein as depicted in FIGS. 13 and 14. The pistons of the engine are mechanically coupled to the crankshaft 48 through connecting rods 50. Each connecting rod 50 has one big end 114 directly connected to the crankshaft 48 in a suitable manner. The big end 114 follows a circular rotation about the crank shaft axis. The opposite small end 116 of each connecting rod is suitably connected to one of the pistons 20, 24 disposed within a cylinder of the engine. As combustion occurs within a given cylinder, it drives the piston downward, which places the connecting rod 50 in compression and causes it to push the crankshaft 48 in an orbit about its rotational axis. This is how useful mechanical work is derived from fuel energy by the engine. During a compression or exhaust stroke of the engine, the crankshaft 48 will drive a piston through a connecting rod 50 in order to perform work on the gases disposed within the cylinder.

As can be seen, that much of the engine structure is similar to a conventional engine and therefore allows many conventional engines to be converted to the configuration of the present invention. For instance, the engine shown in FIGS. 13 and 14 could have converted from a conventional four stroke engine by changing the crankshaft 48, the cam 110, the cam pulley 122, making some modifications to the cylinder head 68 and adding a conduit 28 among other changes.

The apertures that provide fluid communication between the various portions of the engine, including the intake port 95, the mixing cylinder 22, the conduit 28, the power cylinder 26, and the exhaust port 96 may comprise any valving or porting means presently known in the art, or that will be subsequently be developed. Such devices may include pressure activated check valves or reed type valves, or ports that open fluid communication to a cylinder when a piston is located to a particular point as it reciprocates through the cylinder as the invention is not limited in this respect. Additionally, solenoid actuated valves may be used in the engine design. Solenoid actuated valves can offer a wide range of flexibility as to when a given aperture is opened. These valves may also allow the valve opening time to be adjusted during the operation of the engine. Such opening and closing may be controlled by a programmable engine control module (ECM) that operates the engine for optimum performance.

Figure 15:
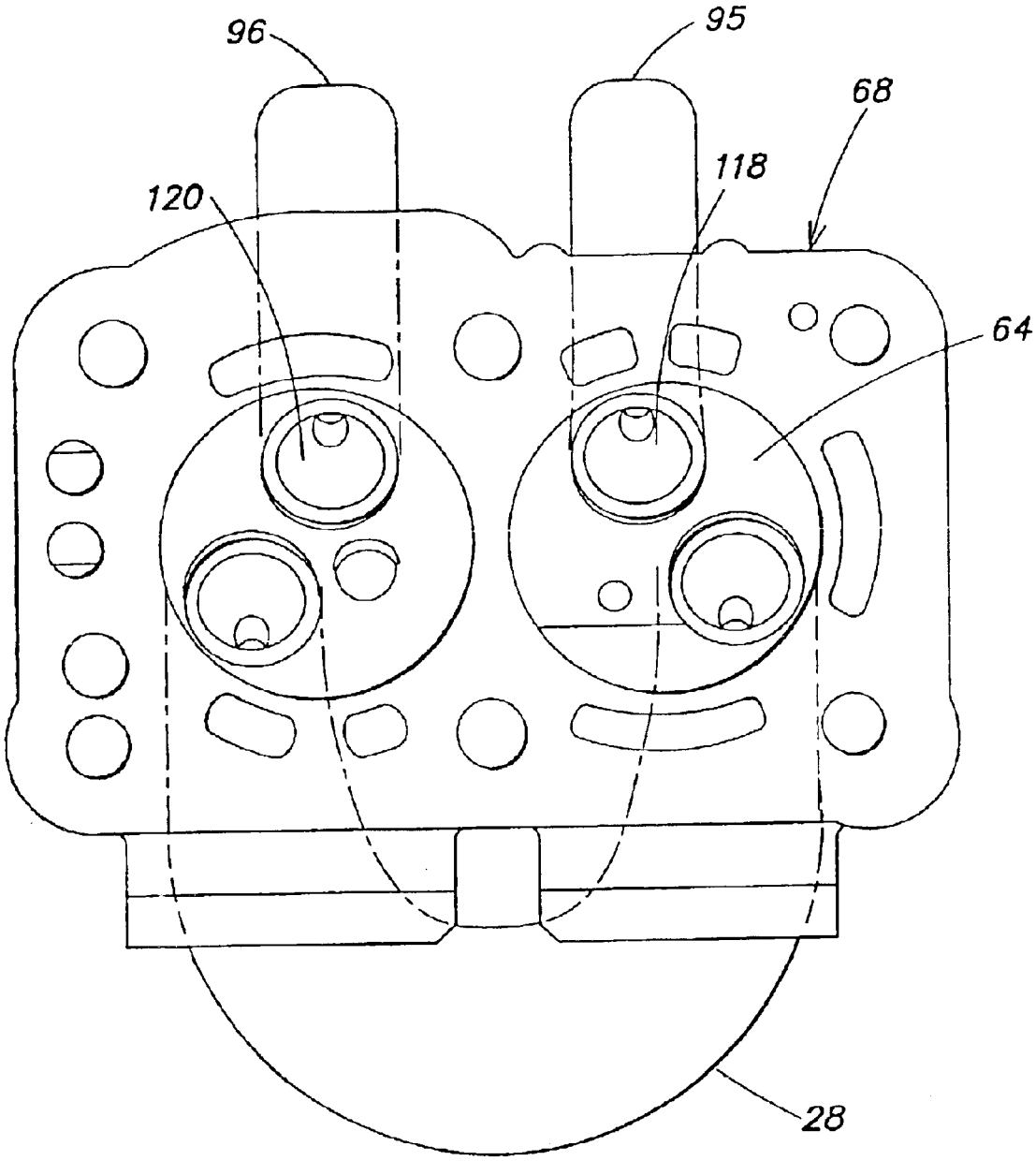
FIG. 15 is a schematic view of a cylinder head that may be used in conjunction with the embodiment shown in FIG. 1.
Figure 16:
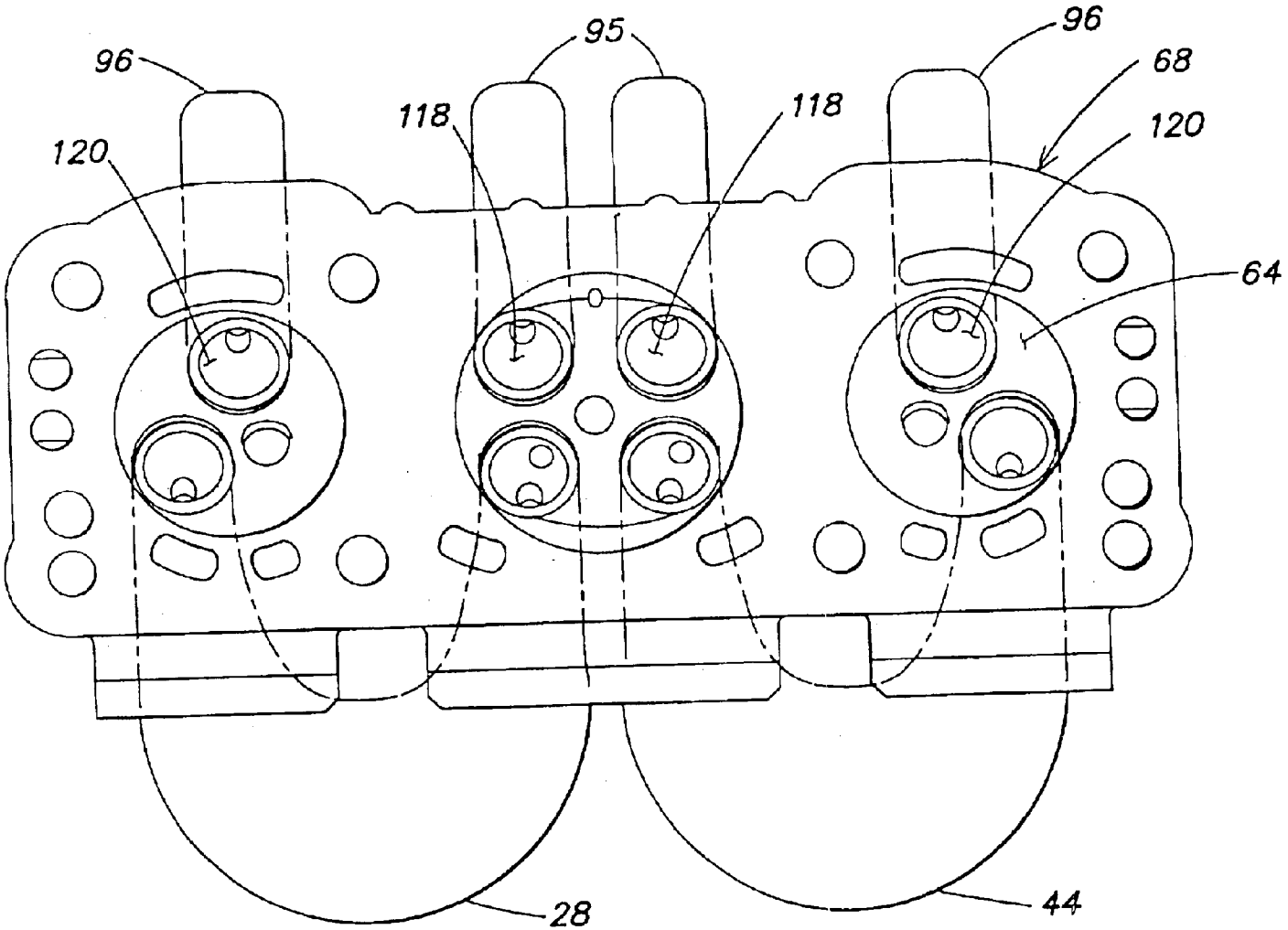
FIG. 16 is a schematic view of a cylinder head that may be used in conjunction with the embodiment shown in FIG. 2.

FIG. 15 shows the cylinder head 68 firedeck 64 or an embodiment with one mixing cylinder 22 supplying one power cylinder 26. FIG. 16 shows the cylinder head 68 firedeck 64 of an embodiment with one mixing cylinder 22 supplying multiple power cylinders, 26, 42 as is also shown in FIG. 2. While these figures each show two intake apertures 118 disposed within the mixing cylinder 22, any other suitable number of apertures could also be used. Similarly, only one exhaust aperture 120 is shown in each of the power cylinders 26, 42. Alternatively, a plurality of exhaust apertures 120 may be disposed within each power cylinder 26, 42. In a similar manner, each conduit 28 is shown to have one aperture at either end of the conduit. However, a conduit may comprise a branch structure at either or both of its ends that provide fluid communication between mixing cylinders 22 and power cylinders 26 through multiple apertures as the invention is not limited in this respect. Still, in other embodiments multiple conduits 28 may be used to provide fluid communication between one mixing cylinder 22 and one power cylinder 26. The apertures 118, 120 shown in FIG. 15 each have a 20 mm diameter and each of the parts (intake, transfer, and exhaust) are each approximating 40 mm long. The conduits 28 in this embodiment are each approximately 140 mm long, although location and size of any of these features may be varied to meet the needs of any particular embodiment. In particular, the size and location of the parts and apertures may be varied to tune the amount of combustion products that remain in the cylinder as re-circulated exhaust gases.

Having described several embodiments of the invention in detail, various modifications and improvements will readily occur to those skilled in the art. Such modifications and improvements are intended to be within the spirit and scope of the invention. Accordingly, the foregoing description is by way of example only and is not intended as limiting. The invention is limited only as defined by the following claims and the equivalence thereto.

What is claimed is:

1. An internal combustion engine comprising:

a cylinder block having a first cylinder and a second cylinder;

a first piston disposed in the first cylinder, and adapted to reciprocate through a first swept volume for substantially completing an intake stroke and a first compression stroke within the first cylinder to form a homogeneous, gaseous air and fuel charge;

a second piston disposed in the second cylinder, and adapted to reciprocate through a second swept volume for substantially completing at least a second compression stroke, a power stroke and an exhaust stroke within the second cylinder;

a crankshaft rotatably mounted within the cylinder block about an axis of rotation;

a first connecting rod having a first end operably coupled to the first piston and a second end operably coupled to the crankshaft such that the second end of the first connecting rod is adapted to rotate with the crankshaft in a circular orbit about the axis of rotation;

a second connecting rod having a first end operably coupled to the second piston and a second end operably coupled to the crankshaft such that the second end of the second connecting rod is adapted to rotate with the crankshaft in a circular orbit about the axis of rotation; and a conduit in fluid communication between the first swept volume and the second swept volume for delivering the air and fuel charge from the first swept volume to the second swept volume, the conduit having a first portion opening into the first cylinder and a second portion opening into the second cylinder, the first portion including a first valve selectively closable for closing fluid communication between the first swept volume and the conduit, the second portion including a second valve selectively closable for closing fluid communication between the second swept volume and the conduit, the second valve adapted to open out of phase with the first valve.

2. An internal combustion engine comprising:

a cylinder block having a first cylinder and a second cylinder;

a first piston disposed in the first cylinder, and adapted to reciprocate through a first swept volume for substantially completing an intake stroke and a first compression stroke within the first cylinder to form a homogenous, gaseous air and fuel charge;

a second piston disposed in the second cylinder, and adapted to reciprocate through a second swept volume for substantially completing at least a second compression stroke, a power stroke and an exhaust stroke within the second cylinder, the second swept volume being smaller than the first swept volume;

a crankshaft rotatably mounted within the cylinder block about an axis of rotation;

a first connecting rod having a first end operably coupled to the first piston and a second end operably coupled to the crankshaft such that the second end of the first connecting rod is adapted to rotate with the crankshaft in a circular orbit about the axis of rotation;

a second connecting rod having a first end operably coupled to the second piston and a second end operably coupled to the crankshaft such that the second end of the second connecting rod is adapted to rotate with the crankshaft in a circular orbit about the axis of rotation; and a conduit in fluid communication between the first swept volume and the second swept volume for delivering the air and fuel charge from the first swept volume to the second swept volume, the conduit having a first portion opening into the first cylinder and a second portion opening into the second cylinder, the first portion including a first valve selectively closable for closing fluid communication between the first swept volume and the conduit, the second portion including a second valve selectively closable for closing fluid communication between the second swept volume and the conduit.

3. The internal combustion engine of any of claims 1–2 wherein the conduit is an accumulator for storing the air and fuel charge under pressure during the intake, compression, power, and exhaust stroke of at least one crankshaft revolution.

4. The internal combustion engine of any of claims 1–2 further comprising:

an exhaust passage in fluid communication with the second swept volume, the passage being selectively closable, the exhaust passage adapted to remain open for a period of time while the second portion is open.

5. The internal combustion engine of claim 2 wherein the exhaust passage is adapted to remain open for between 10 and 15 crank angles while the second portion is open.

6. The internal combustion engine of any claims 1–2 further comprising:

a fuel injector adapted to deliver a volume of fuel into the first cylinder.

7. The internal combustion engine of any of claims 1–2 wherein a temperature of the air charge promotes fuel evaporation and improves volumetric efficiency.

8. The internal combustion engine of any of claims 1–2 wherein a time when the first portion of the conduit closes fluid communication between the conduit and the first swept volume is selectable.

9. The internal combustion engine of any of claims 1–2 wherein a time when the second portion of the conduit closes fluid communication between the conduit and the second swept volume is selectable.

10. The internal combustion engine of any of claims 1–2 wherein the first and second valves are piston closable ports, cam actuated valves, pressure actuated valves, or solenoid actuated valves.

11. The internal combustion engine of any of claims 1–2 wherein the conduit defines a volume that is substantially the same as the first swept volume.

12. The internal combustion engine of any of claims 1–2 further comprising:

a spark producing device disposed within the second swept volume for igniting a fuel and air mixture within the second cylinder.

13. An internal combustion engine comprising:

a cylinder block having a first cylinder, a second cylinder, and a third cylinder;

a first piston disposed in the first cylinder, and adapted to reciprocate through a first swept volume for substantially completing an intake stroke and a first compression stroke within the first cylinder to form a homogenous, gaseous air and fuel charge;

a second piston disposed in the second cylinder, and adapted to reciprocate through a second swept volume for substantially completing at least a second compression stroke, a power stroke and an exhaust stroke within the second cylinder;

a third piston disposed in the third cylinder, and adapted to reciprocate through a third swept volume for substantially completing at least a third compression stroke, a power stroke and an exhaust stroke within the third cylinder;

a crankshaft rotatably mounted within the cylinder block about an axis of rotation;

a first connecting rod having a first end operably coupled to the first piston and a second end operably coupled to the crankshaft such that the second end of the first connecting rod is adapted to rotate with the crankshaft about the axis of rotation;

a second connecting rod having a first end operably coupled to the second piston and a second end operably coupled to the crankshaft such that the second end of the second connecting rod is adapted to rotate with the crankshaft about the axis of rotation;

a third connecting rod having a first end operably coupled to the third piston and a second end operably coupled to the crankshaft such that the second end of the third connecting rod is adapted to rotate with the crankshaft about the axis of rotation;

a first conduit in fluid communication between the first swept volume and the second swept volume;

a second conduit in fluid communication between the first swept volume and the third swept volume;

a first closable portion including a first valve for closing fluid communication between the first swept volume and the first conduit;

a second closable portion including a second valve for closing fluid communication between the first swept volume and the second conduit.

14. An internal combustion engine comprising:

a cylinder block having a first cylinder, a second cylinder, and a third cylinder;

a first piston disposed in the first cylinder, and adapted to reciprocate through a first swept volume for substantially completing an intake stroke and a first compression stroke within the first cylinder to form a homogeneous, gaseous air and fuel charge;

a second piston disposed in the second cylinder, and adapted to reciprocate through a second swept volume for substantially completing at least a second compression stroke, a power stroke and an exhaust stroke within the second cylinder;

a third piston disposed in the third cylinder, and adapted to reciprocate through a third swept volume for substantially completing at least a third compression stroke, a power stroke and an exhaust stroke within the third cylinder;

a first conduit providing fluid communication between the first swept volume and the second swept volume;

a second conduit providing fluid communication between the first swept volume and the third swept volume;

a first closable portion for closing fluid communication between the first swept volume and the first conduit;

a second closable portion for closing fluid communication between the first swept volume and the second conduit;

a third closable portion for closing fluid communication between the first conduit and the second swept volume; and a fourth closable portion for closing fluid communication between the second conduit and the third swept volume.

15. The internal combustion engine of claim 14 wherein a time when the third portion of the first conduit closes fluid communication between the first conduit and the second swept volume is selectable.

16. The internal combustion engine of claim 14 wherein a time when the fourth portion of the second conduit closes fluid communication between the second conduit and the third swept volume is selectable.

17. The internal combustion engine any of claims 13–14 wherein a time when the first portion of the first conduit closes fluid communication between the first conduit and the first swept volume is selectable.

18. The internal combustion engine any of claims 13–14 wherein a time when the second portion of the second conduit closes fluid communication between the second conduit and the first swept volume is selectable.

19. The internal combustion engine of any of claims 13–14 wherein any of the valves of the closable portions are selected from the group consisting of piston closable ports, cam actuated valves, pressure actuated valves, and solenoid actuated valves.

20. The internal combustion engine of any of claims 13–14 wherein the first swept volume is greater than the second swept volume and the third swept volume combined.

21. The internal combustion engine of any of claims 13–14 wherein the first swept volume is substantially equal to the second swept volume and the third swept volume combined.

22. The internal combustion engine of any claims 13–14 wherein the first and second conduits are accumulators, each storing a portion of the air and fuel charge under pressure during the intake, compression, power, and exhaust stroke of at least one crankshaft revolution.

23. The internal combustion engine of any of claims 13–14 further comprising:

a fuel injector adapted to deliver a volume of fuel into the first cylinder.

24. The internal combustion engine of any of claims 13–14 wherein a temperature of the air charge promotes fuel evaporation and improves volumetric efficiency.

25. The internal combustion engine of any of claims 13–14 further comprising:

a spark producing device disposed within the second cylinder for igniting a fuel and air mixture within the second cylinder; and a spark producing device disposed within the third cylinder for igniting a fuel and air mixture within the third cylinder.

26. An internal combustion engine having a pair of cylinders each having a reciprocating piston connected to a common crankshaft by a connecting rod, said rods sized and positioned to maintain constant phase angles, one of the cylinders adapted for an air and fuel intake stroke and a primary compression stroke only, and the other of the cylinders adapted for at least a secondary compression stroke, a power stroke and an exhaust stroke, a conduit adapted for transferring air and fuel gases only from the one into the other cylinder after the primary compression stroke, and-means for isolating gases in the conduit intermediate the primary and secondary compression strokes at an elevated pressure, wherein the conduit is positioned above at least a portion of the cylinders whereby any volume of liquefied fuel transferred from the one cylinder to the conduit is minimized.

27. An internal combustion engine comprising:

a first cylinder for receiving air and fuel to be mixed in the first cylinder and compressed within the first cylinder by a first piston driven by a first connecting rod, thereby creating a compressed air/fuel charge;

a crankshaft that drives the first connecting rod, the connecting rod having an end operably connected to the crankshaft that follows a circular orbit about an axis;

a chamber in selectable fluid communication with the first cylinder, the chamber adapted to receive substantially all of the compressed air/fuel charge while retaining any liquid fuel in the first cylinder, the chamber further adapted to contain the compressed air/fuel charge as a first portion of a compressed air/fuel mixture and to maintain the compressed air fuel mixture at an elevated, operating pressure range; and a second cylinder in selectable fluid communication with the chamber, the second cylinder adapted to receive a second portion of the compressed air/fuel mixture as a second compressed air/fuel charge, the second cylinder also adapted to further compress the second air/fuel charge, and to combust the second compressed air/fuel charge to drive a second piston connected to a second connecting rod, wherein the second connecting rod has an end operably connected to the crankshaft, the second connecting rod driving the crankshaft and the end of the second connecting rod in a circular orbit about the axis.

28. A four-stroke cycle internal combustion engine comprising:

a cylinder block having a plurality of cylinders formed therein;

a plurality of pistons, each disposed in one of the plurality of cylinders to define a cylinder chamber;

at least one accumulator in fluid communication with each cylinder chamber;

a compressor in intermittent communication with the at least one accumulator;

an air delivery system communicating with at least the compressor to deliver air to the compressor;

a fuel delivery system communicating with at least the compressor to deliver fuel to the compressor; and wherein the compressor compresses and mixes the air and fuel to form an air/fuel charge for subsequent delivery to the accumulator and whereafter, the air/fuel charge is delivered from the accumulator to at least one cylinder chamber, wherein all four strokes of the engine cycle are completed.

29. The engine according to claim 28, wherein the compressor comprises a compression cylinder housing a compressor piston.

30. The engine according to claim 29, wherein one of the plurality of cylinders comprises the compression cylinder and wherein one of the plurality of pistons comprises the compressor piston.

31. The engine according to claim 28, wherein the compressor compresses and mixes the air and fuel to form a substantially homogenous air/fuel charge.

32. The engine according to claim 28, wherein the air/fuel charge is held in the accumulator for a predetermined time.

33. The engine according to claim 28, wherein the accumulator delivers the air/fuel charge to a cylinder chamber when the corresponding piston is in an intake stroke.

34. The engine according to claim 28, wherein the accumulator delivers the air/fuel charge to a first cylinder chamber when the corresponding first piston is in its intake stroke and wherein the accumulator delivers the air/fuel charge to a second cylinder chamber when the corresponding second piston is in its intake stroke.

35. The engine according to claim 34, wherein the intake stroke of the first piston occurs at a time that is different from the intake stroke of the second piston.

36. The engine according to claim 28, further comprising a first valve disposed between the compressor and the accumulator and a second valve disposed between the accumulator and a cylinder chamber, wherein after the air/fuel charge is delivered to the accumulator, each of the first and second valves is held in a closed state to maintain the air/fuel charge in the accumulator.

37. The engine according to claim 28, wherein the compressor defines a compressor chamber having a compressor chamber volume and wherein the cylinder chamber defines a cylinder chamber volume, the compressor chamber volume being greater than the cylinder chamber volume.

38. The engine according to any of claims 1, 2, 13, 14, 26 and 27, wherein the second piston also completes an intake stroke.

* * * * *